US009483031B2

(12) United States Patent
Yanagisawa

(10) Patent No.: US 9,483,031 B2
(45) Date of Patent: Nov. 1, 2016

(54) ELECTRONIC TIMEPIECE WITH INTERNAL ANTENNA

(71) Applicant: Seiko Epson Corporation, Tokyo (JP)

(72) Inventor: Toshiaki Yanagisawa, Suwa (JP)

(73) Assignee: Seiko Epson Corporation (JP)

( * ) Notice: Subject to any disclaimer, the term of this patent is extended or adjusted under 35 U.S.C. 154(b) by 153 days.

(21) Appl. No.: 14/031,129

(22) Filed: Sep. 19, 2013

(65) Prior Publication Data

US 2014/0086027 A1 Mar. 27, 2014

(30) Foreign Application Priority Data

Sep. 24, 2012 (JP) ..... 2012-209029
Sep. 24, 2012 (JP) ..... 2012-209031

(51) Int. Cl.
*G04R 60/10* (2013.01)
*G04G 17/04* (2006.01)
*G04R 20/04* (2013.01)

(52) U.S. Cl.
CPC ..... *G04R 60/10* (2013.01); *G04G 17/045* (2013.01); *G04R 20/04* (2013.01)

(58) Field of Classification Search
CPC ..... G04R 60/10; G04R 60/12; G04B 29/00; G04B 29/02; G04B 29/022; G04B 37/00; G04B 37/0008
See application file for complete search history.

(56) References Cited

U.S. PATENT DOCUMENTS 5,526,006 A * 6/1996 Akahane et al. ..... 343/718
8,456,959 B2 6/2013 Fujisawa
2006/0220957 A1* 10/2006 Tanaka et al. ..... 343/700 R
2007/0070818 A1* 3/2007 Inomata et al. ..... 368/10
2008/0293373 A1* 11/2008 Yasuoka et al. ..... 455/347
2009/0316536 A1* 12/2009 Kachi et al. ..... 368/278
2010/0097895 A1* 4/2010 Sumida et al. ..... 368/28
2011/0102274 A1 5/2011 Fujisawa
2012/0162030 A1* 6/2012 Yokoo et al. ..... 343/702
2012/0170423 A1* 7/2012 Fujisawa ..... 368/10
2012/0320715 A1* 12/2012 Maruyama ..... 368/10
2013/0181873 A1* 7/2013 Gutschenritter et al. ..... 343/718

FOREIGN PATENT DOCUMENTS

JP 55-086980 U 6/1980
JP 57-004775 U 1/1982
JP 2008-020326 A 1/2008
JP 2011-021929 A 2/2011
JP 2011-097431 A 5/2011
JP 2013-181918 9/2013
JP 2013-181919 9/2013
JP 2013-181920 9/2013

* cited by examiner

*Primary Examiner* — Amy Cohen Johnson
*Assistant Examiner* — Jason Collins
(74) *Attorney, Agent, or Firm* — Harness, Dickey & Pierce, P.L.C.

(57) ABSTRACT

An electronic timepiece has a main plate 120 for a movement 110 that drives a time display unit inside an outside case 80; an annular antenna 40 housed inside the case 80 and positioned relative to the main plate 120; and aback cover 85 that engages the case 80. A circuit bridge 130 disposed below the main plate 120 has an upward pressure part 131 that pushes the main plate 120 to the time display unit side when the case 80 and back cover 85 are engaged. The main plate 120 has a movement top positioning part 122 that contacts the vertical positioning surface and positions the main plate 120 vertically to the case 80 when the main plate 120 is lifted toward the time display side by the upward pressure part 131.

11 Claims, 14 Drawing Sheets

ELECTRONIC TIMEPIECE WITH INTERNAL ANTENNA

BACKGROUND

1. Technical Field

The present invention relates to an electronic timepiece with an internal antenna.

2. Related Art

Electronic timepieces that receive signals from positioning information satellites such as GPS (Global Positioning System) satellites to display time accurately are known from the literature. Such electronic timepieces commonly have a ring-shaped antenna for receiving radio signals from the positioning information satellites. See, for example, Japanese Unexamined Patent Appl. Pub. JP-A-2011-21929.

In this type of electronic timepiece, the ring-shaped antenna is disposed inside the outside case around the time display part (such as the dial) of the electronic timepiece. The antenna is also commonly covered from above by a dial ring for aesthetic purposes. The dial ring is also usually plastic or other non-conductive material in order to achieve better reception performance in the antenna.

The antenna can conceivably be held by the outside case in order to maintain a specific distance between the antenna and the case in timepieces according to the related art, but because suitable reception performance must be maintained in the antenna when driving an electronic timepiece with an internal antenna, the antenna is typically fixed in position relative to the movement during the manufacturing process.

However, if the outside case member located close to the antenna is metal, and the ring-shaped antenna is disposed close to the metal case, the resonance frequency characteristic of the antenna may vary. To maintain good signal reception performance in the antenna of an electronic timepiece with internal antenna, maintaining a specific distance between the antenna and the case, and keeping the effect of the case on reception performance constant, are therefore important.

Because even the plastic materials used for the dial ring have slight permittivity, the resonance frequency of the antenna disposed near the dial ring fluctuates and affects the signal reception performance of the antenna. To maintain good signal reception performance in the antenna of an electronic timepiece with internal antenna, maintaining a specific distance between the antenna and the dial ring, and keeping the effect of the dial ring on reception performance constant, are therefore important.

SUMMARY

The present invention is directed to the foregoing problem by maintaining a constant distance between the antenna and outside case, and assuring good antenna reception performance in an electronic timepiece with internal antenna having an antenna that is positioned and fixed to the movement. The invention also maintains a constant relative position between the antenna and dial ring, and assures good antenna reception performance in an electronic timepiece with internal antenna.

One aspect of the invention is an electronic timepiece with internal antenna, including: a tubular outside case; a time display unit that displays time inside the case; a back cover that closes a case opening on the opposite side as the display side of the time display unit; a movement including a drive mechanism that drives the time display unit and a main plate that supports the drive mechanism; a vertical positioning surface that projects in the radial direction of the case on the inside of the case; and an annular antenna that is held inside the case and is positioned relative to the movement; the main plate having an upward pressure part that engages the back cover and lifts the movement to the time display side, and a movement top positioning part that contacts the vertical positioning surface and positions the movement vertically to the case when the upward pressure part lifts the movement to the time display side.

In the electronic timepiece with internal antenna according to this aspect of the invention, the antenna is positioned relative to the movement. Because the main plate has an upward pressure part that lifts the movement to the time display side, and a movement top positioning part that positions the movement vertically to the case, reaction from the back cover works on the movement, the movement is positioned vertically to the outside case, and the antenna is positioned and fixed vertically relative to the case, as a result of fitting the outside case to the main plate of the movement on the back cover. As a result, the distance between the antenna and the outside case can be held constant, the effect of the case can be kept constant, and good antenna reception performance can be maintained.

In an electronic timepiece with internal antenna according to another aspect of the invention, a horizontal positioning surface is formed on the inside surface of the outside case; and a movement outside diameter engaging part that contacts the horizontal positioning surface and determines the horizontal position relative to the outside case is formed on the main plate.

By positioning and fixing the movement horizontally relative to the outside case, the antenna is also positioned and fixed horizontally to the case. As a result, the distance between the antenna and the outside case can be held constant, the effect of the case can be kept constant, and good antenna reception performance can be maintained.

Note that "tubular" as used herein includes rotational bodies represented by tubes.

"Annular" as used herein includes circles and rectangles, as well as open (such as C-shaped) rings that are open in part, and closed (such as O-shaped) rings that are completely closed.

The time display unit includes a timepiece dial, and the time display on this dial includes both analog displays with hands, and LCD or other digital displays. Examples of such hands include an hour hand, minute hand, and second hand.

"Horizontal" as used herein means within a plane parallel to the display surface of the time display unit, or the two-dimensional direction in a plane parallel to the radial direction of the cylindrical outside case. "Vertical" means the normal direction (display direction) perpendicular to the display surface of the time display unit, or the two-dimensional direction in the plane parallel to the direction perpendicular to the radial direction of the tubular outside case.

In an electronic timepiece according to another aspect of the invention, the main plate includes a first member made of a hard material disposed on the face side of the time display unit, and a second member made of a softer material than the first member and disposed on the back cover side. The movement outside engaging part and movement top positioning part are disposed to the first member, and the upward pressure part is disposed to the second member.

Because the upward pressure part is made of a soft material, the upward pressure part deforms slightly due to its pliability and elasticity when extreme pressure is applied from the back cover, and thus absorbs the pressure and is not damaged. By receiving and transferring reaction from the back cover to the above first member, the movement top positioning part is pushed against the vertical positioning surface of the case, and the main plate is positioned and fixed vertically to the case. The movement is also pressed and positioned relative to the case side because the outside diameter engaging part and the top positioning part of the movement are made of a hard material.

The upward pressure part can be formed by a member separate from the main plate. In this embodiment, the upward pressure part can be made from a different material than the main plate, pliability to reaction from the back cover and the strength required to secure the movement can be separately set, and the ease and freedom of design can be improved.

In an electronic timepiece with internal antenna according to another aspect of the invention, the upward pressure part is disposed between the main plate and the outside case, and includes a spacer outside diameter engaging part that contacts the horizontal positioning surface formed on the inside of the outside case, a spacer inside diameter positioning surface that contacts a movement outside diameter engaging part disposed to the outside surface of the main plate, a spacer lifter that engages the back cover and lifts the movement to the time display side, and a movement lifter that contacts a shoulder formed on the outside surface of the main plate.

By using the upward pressure part, this aspect of the invention can position and secure the main plate horizontally and vertically to the outside case even when the upward pressure part and the main plate are discrete members. More specifically, because the upward pressure part has a spacer outside diameter engaging part and a spacer inside diameter positioning surface, the movement outside diameter engaging part contacts the spacer inside diameter positioning surface, the spacer outside diameter engaging part contacts the horizontal positioning surface, and the spacer outside diameter engaging part is pushed to the outside when the upward pressure part is installed between the main plate and the case. As a result, the movement is positioned and secured horizontally relatively to the outside case.

Furthermore, because the upward pressure part includes a spacer lifter and a movement lifter, reaction from the back cover works on the upward pressure part and the spacer lifter is pushed in by fitting the case to the main plate of the movement disposed to the back cover. The pressure of fitting the case to the main plate of the movement also acts on the movement lifter that contacts a shoulder formed on the outside edge of the main plate, and the movement lifter pushes the main plate up. As a result, the movement top positioning part disposed to the main plate is pressed to the vertical positioning surface of the case, and the movement is positioned and secured vertically relative to the case.

In an electronic timepiece with internal antenna according to another aspect of the invention, the antenna receives signals from a positioning information satellite; and the movement is driven to display time based on the received signals.

This aspect of the invention enables accurately displaying the time.

Because the movement is thus positioned and fixed horizontally and vertically relative to the outside case, the antenna is also positioned and fixed horizontally and vertically relative to the case. As a result, the distance between the antenna and the outside case can be held constant, the effect of the case can be kept constant, and good antenna reception performance can be maintained.

Another aspect of the invention is an electronic timepiece with internal antenna, including: a tubular outside case; a movement housed inside the outside case and including a drive mechanism that drives a time display unit and a main plate that supports the drive mechanism; an annular antenna that is held inside the outside case; an annular top member disposed above the antenna; an antenna engaging part that positions the antenna relative to the movement; and a top member engaging part that positions the top member relative to the movement; the antenna engaging part and the top member engaging part being formed with the main plate.

In the electronic timepiece with internal antenna according to this aspect of the invention, the antenna engaging part and the top member engaging part are formed in unison with the main plate of the movement. The antenna and top member are respectively engaged by the antenna engaging part and the top member engaging part. Therefore, because the antenna and top member are engaged by the antenna engaging part and the top member engaging part formed in unison with the main plate, the relative positions of the antenna and top member can be kept constant, the effect of the top member on the antenna can be kept constant, and good antenna reception performance can be maintained.

The top member as used here includes members disposed above (on the crystal side of) the antenna, including the annular dial ring conforming to the shape of the antenna, and the dial.

Preferably, the antenna engaging part positions and prevents the antenna from moving horizontally and circumferentially relative to the main plate; and the top member engaging part positions and prevents the top member from moving horizontally and circumferentially relative to the main plate.

"Horizontal" as used herein means within a plane parallel to the display surface of the time display unit, or the two-dimensional direction in a plane parallel to the radial direction of the cylindrical outside case. "Vertical" means the normal direction (display direction) perpendicular to the display surface of the time display unit, or the two-dimensional direction in the plane parallel to the direction perpendicular to the radial direction of the tubular outside case.

Further preferably, the antenna engaging part has an antenna protrusion formed protruding vertically from the main plate; and the antenna has an antenna cavity that engages the antenna protrusion.

In another aspect of the invention, the top member engaging part has a top member protrusion formed protruding vertically from the main plate; and the top member has a top member cavity that engages the top member protrusion.

These aspects of the invention can easily position the antenna and top member horizontally and circumferentially relative to the movement.

Other objects and attainments together with a fuller understanding of the invention will become apparent and appreciated by referring to the following description and claims taken in conjunction with the accompanying drawings.

DESCRIPTION OF EMBODIMENTS

Preferred embodiments of the present invention are described below with reference to the accompanying figures. Note that the size and scale of parts shown in the figures differ from the actual size and scale for convenience. Furthermore, the following examples are specific preferred embodiments of the invention and describe technically desirable limitations, and the scope of the invention is not limited thereby unless such limitation is specifically stated below.

Embodiment 1

A first embodiment of the invention is described below with reference to FIG. 1 to FIG. 8.

Figure 1:
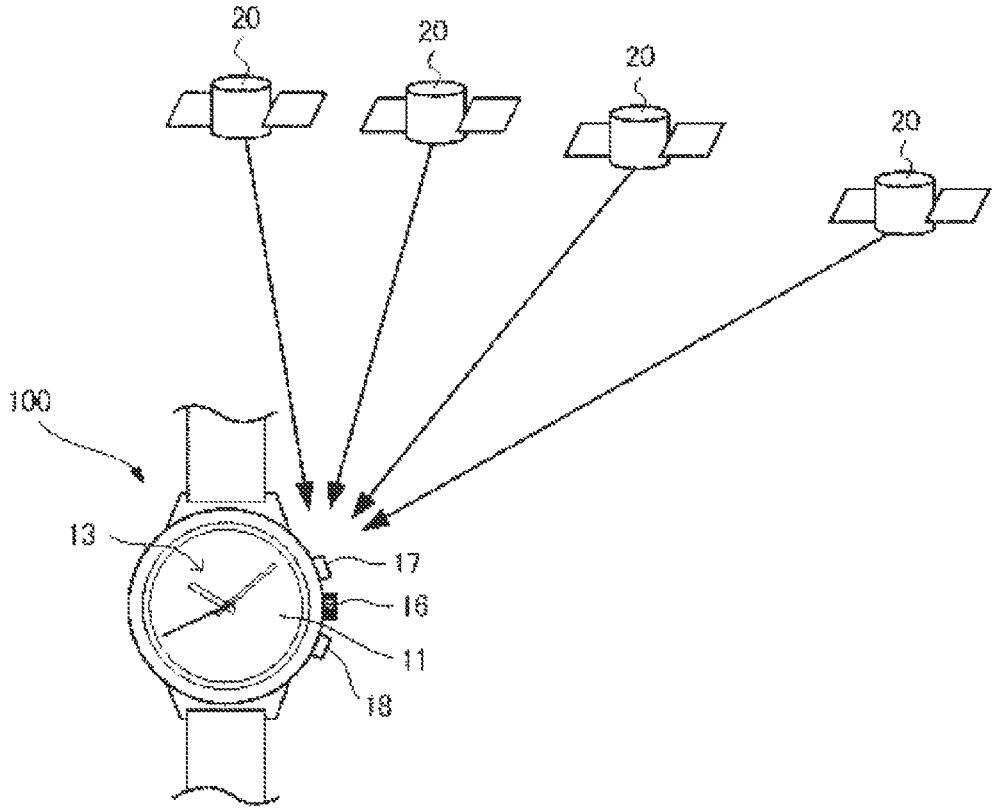
FIG. 1 is an overview of a GPS system including an electronic timepiece 100 with an internal antenna according to a first embodiment of the invention.

A. Mechanical Configuration of an Electronic Timepiece with Internal Antenna FIG. 1 shows the basic concept of a GPS system that includes an electronic timepiece 100 with an internal antenna according to a preferred embodiment of the invention.

The electronic timepiece 100 is a wristwatch that receives signals (radio signals) from at least one of plural GPS satellites 20 and adjusts the time based thereon, and displays the time on the surface (side) (referred to below as the "face") on the opposite side as the surface (referred to below as the "back") that contacts the wrist.

A GPS satellite 20 is an example of a positioning information satellite that orbits the Earth on a specific orbit, and transmits a navigation message superimposed on a 1.57542 GHz RF signal (L1 signal). The 1.57542 GHz signal carrying a superimposed navigation message is referred to herein as simply a "satellite signal." These satellite signals are right-handed circularly polarized waves.

The invention is described below using the GPS system as an example of a satellite positioning system, but the invention is not so limited. More particularly, the invention can be used with Global Navigation Satellite Systems (GNSS) such as Galileo (EU), GLONASS (Russia), and Beidou (China), and other positioning information satellites that transmit satellite signals containing time information, including the SBAS and other geostationary or quasi-zenith satellites.

The electronic timepiece 100 may therefore be a wristwatch that receives radio waves (radio signals) from positioning information satellites other than GPS satellites 20, and adjusts the internal time based thereon.

There are currently approximately 31 GPS satellites 20 in the constellation. Only 4 of the 31 satellites are shown in FIG. 1.

Each GPS satellite 20 superimposes a unique pattern called a C/A code (Coarse/Acquisition Code), which is a 1023-chip (1 ms) pseudorandom noise code unique to a specific GPS satellite 20, on the satellite signal. This code is used to identify which GPS satellite 20 transmitted a particular satellite signal. Each chip is a value of +1 or −1, and the C/A code appears to be a random pattern. The C/A code superimposed on the satellite signal can therefore be detected by correlating the satellite signal that is actually received with the known pattern of each C/A code.

Each GPS satellite 20 carries an atomic clock, and the highly precise time information ("GPS time information" below) kept by the atomic clock is included in the satellite signal transmitted by the GPS satellite 20. The time difference of the atomic clock onboard each GPS satellite 20 is measured by the ground control segment, and a time correction parameter for correcting this time difference is also included in the satellite signal. The electronic timepiece 100 receives a satellite signal transmitted from one GPS satellite 20, and adjusts the internal time to the correct time using the GPS time information and time correction parameter contained in the received signal.

Orbit information indicating the position of the GPS satellite 20 on its orbit is contained in the satellite signal. The electronic timepiece 100 can calculate its own position using the GPS time information and orbit information. This position calculation assumes that there is some degree of error in the internal time kept by the electronic timepiece 100. More specifically, in addition to the three parameters for determining the three-dimensional position of the electronic timepiece 100, this time error is also an unknown. The electronic timepiece 100 therefore generally receives satellite signals from four or more GPS satellites, and calculates its own position using the GPS time information and orbit information contained in each of the received signals.

Figure 2:
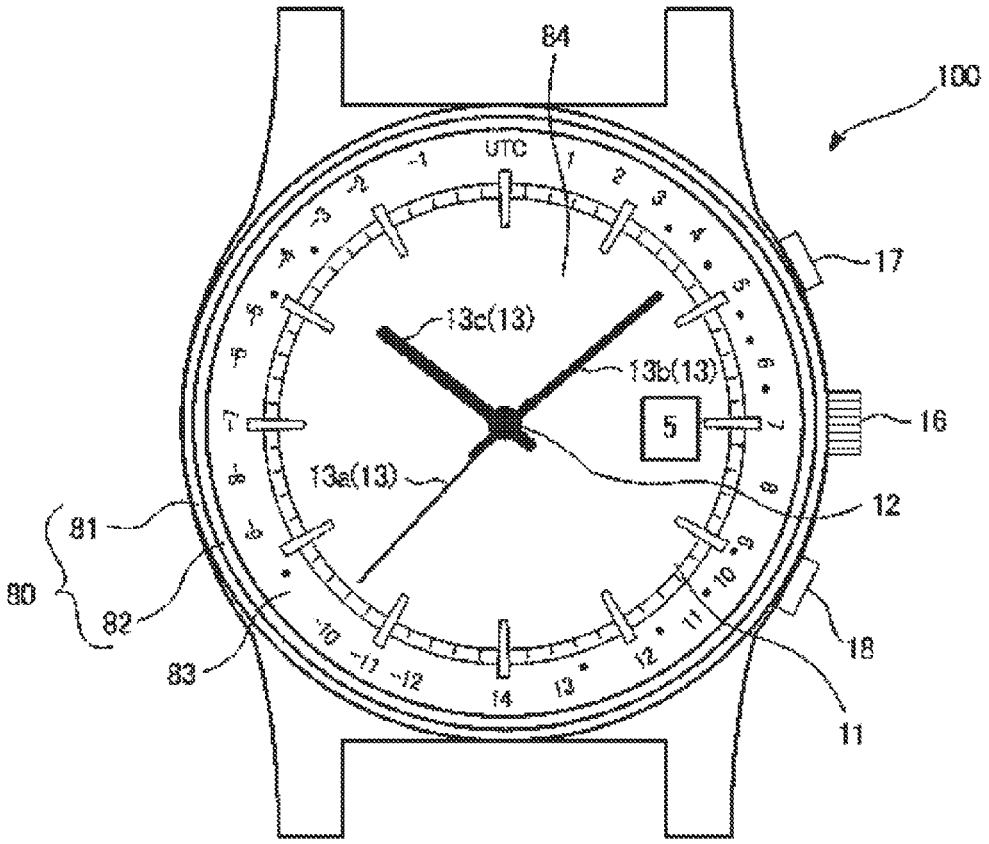
FIG. 2 is a plan view of the electronic timepiece 100.

FIG. 2 is a plan view of the electronic timepiece 100.

As shown in FIG. 2, the electronic timepiece 100 has an outside case 80. The case 80 includes a cylindrical body 81 made of metal or other conductive material, and a bezel 82 made of a non-conductive material such as ceramic. The bezel 82 is pressed into the body 81.

An annular dial ring 83 made of a non-conductive material such as plastic is disposed inside the bezel 82, and a round dial 11 is disposed inside the dial ring 83.

Numbers denoting the offset from UTC are disposed at appropriate intervals around the dial ring 83, and bar-shaped hour markers are disposed every 30 degrees around the dial 11, in this embodiment. The information shown on the dial ring 83 and the information shown on the dial 11 are different from each other, and are not limited to the information shown in the figure.

Hands 13 (13*a* to 13*c*) that turn on a center pivot 12 and indicate the current time are disposed above the dial 11. The dial 11 may also be referred to as the time display unit below.

Further described below, the case 80 has two openings, one each on the face and the back cover sides.

The opening on the face side of the case 80 is covered by a crystal 84 through an intervening bezel 82, and the dial 11 and hands 13 (13*a* to 13*c*) are visible through the crystal 84.

As also shown in FIG. 1 and FIG. 2, the electronic timepiece 100 has a crown 16 and pushers 17, 18. The crown 16 and pushers 17, 18 can be manually operated to set the electronic timepiece 100 to at least a mode (time information acquisition mode) that receives satellite signals from at least one GPS satellite 20 and adjusts the internal time, and a mode (positioning information acquisition mode) that receives signals from plural GPS satellites 20, calculates the current position, and adjusts the time difference of the internal time. The electronic timepiece 100 can also execute the time information acquisition mode and positioning information acquisition mode regularly (automatically).

Figure 3A:
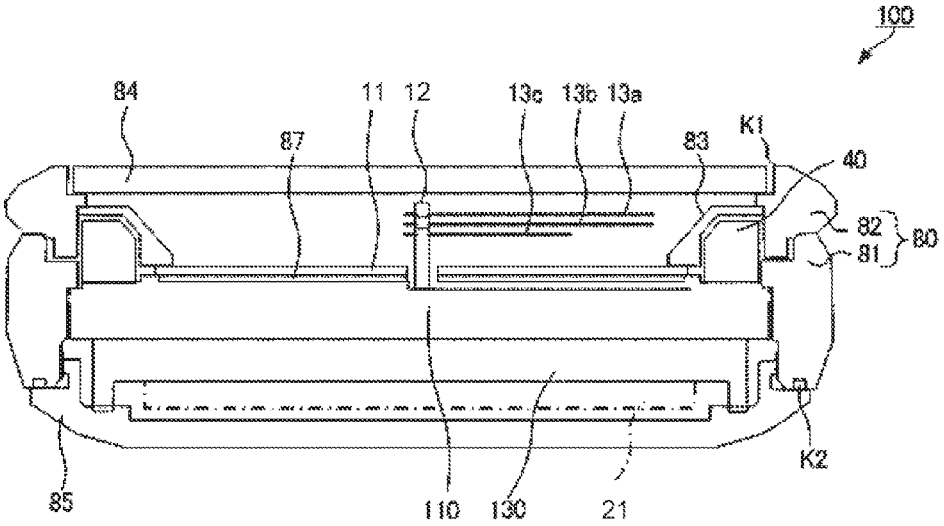
FIG. 3A is a side view of the electronic timepiece 100.
Figure 3B:
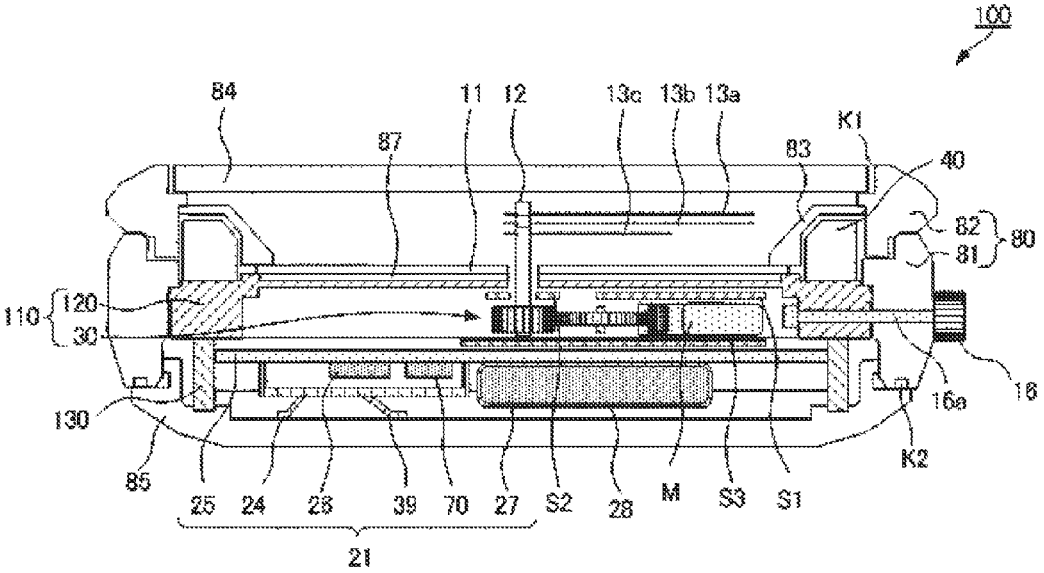
FIG. 3B is a partial section view of the electronic timepiece 100.
Figure 4:
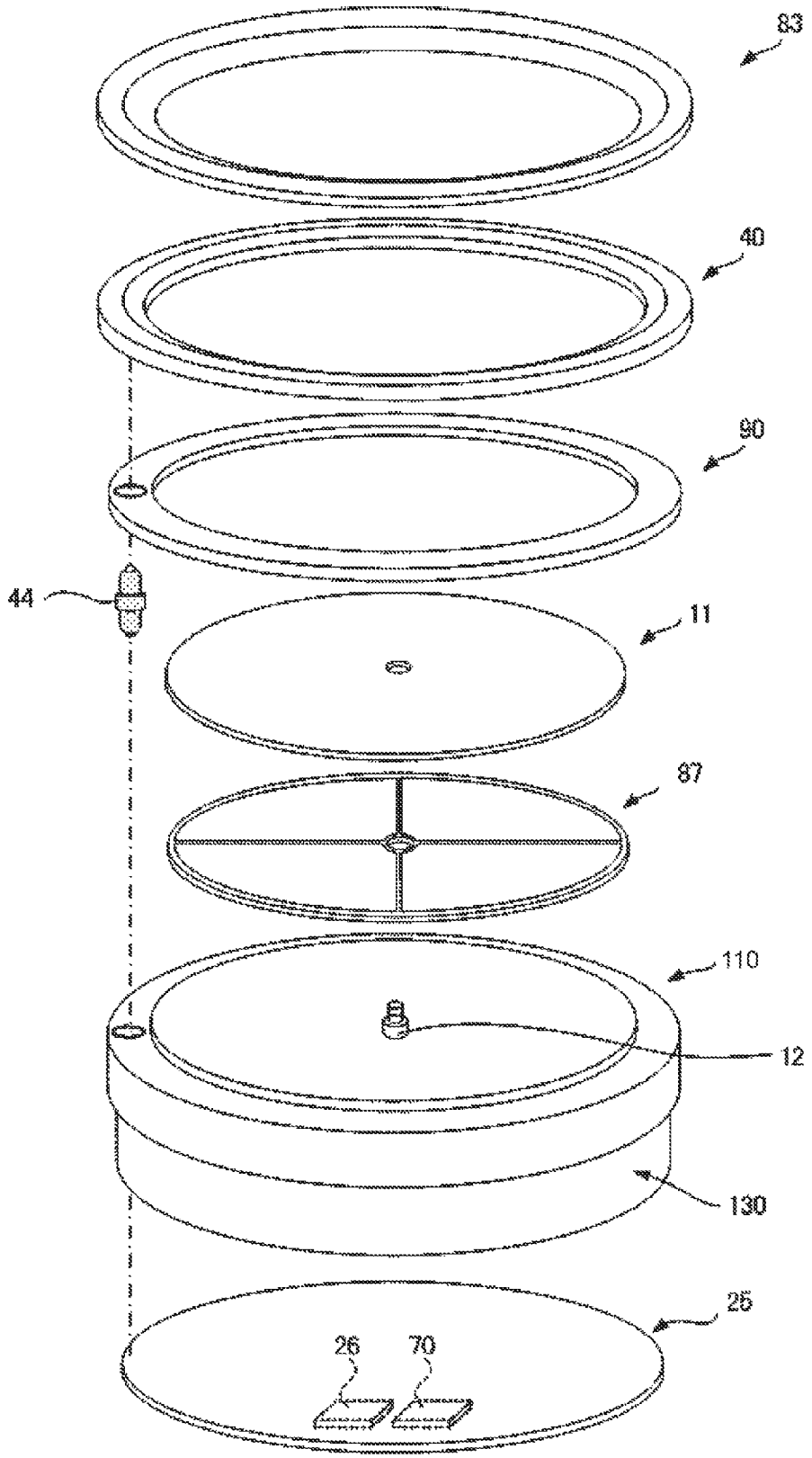
FIG. 4 is an exploded view of part of the electronic timepiece 100.

FIG. 3A is a side view showing the internal structure of the electronic timepiece 100, FIG. 3B is a section view showing part of the internal structure of the electronic timepiece 100, and FIG. 4 is an exploded oblique view showing parts of the electronic timepiece 100.

As shown in FIG. 3A, the electronic timepiece 100 has an outside case 80, a back cover 85 that covers the case opening on the opposite side as the face side of the time display unit, and a movement 110 having a drive mechanism 30 that drives the time display unit, for example.

The case 80 includes a cylindrical body 81 made of metal or other conductive material and a bezel 82 made of a non-conductive material such as ceramic, and the bezel 82 is pressed into the body 81. The case 80 has a top opening K1 and a bottom opening K2. The top opening K1 of the case 80 is covered by the round crystal 84, and the bottom opening K2 is covered by a back cover 85 made of SUS (stainless steel), Ti (titanium), or other conductive material. The body 81 and back cover 85 screw together, for example.

The ring-shaped dial ring 83 made of plastic or other non-conductive material is disposed to the inside circumference of the bezel 82 below (on the back cover side of) the crystal 84. The movement 110 is disposed inside the inside circumference of the body 81 below the dial ring 83.

The movement 110 includes the drive mechanism 30 and a main plate 120 that holds the drive mechanism 30. As shown in FIG. 3A, the movement 110 is fit to the inside of the case 80 and has hands 13 disposed on the time display unit (face) side. The main plate 120 of the movement 110 is a member made from a hard material (first member) that is non-conductive and has a constant strength.

A "hard" material as used here means a material with little deformation to compression and tension, and includes plastics such as PPS (polyphenylene sulfide), PTES (polythioethersulfone), PC (polycarbonate), LCP (liquid crystal polymer), and PA (polyamide).

A circuit bridge 130 is disposed below the movement 110. The circuit bridge 130 is a member that receives and transfers reaction from the back cover 85 to the movement 110 above, and holds a circuit block 21 including the circuit board 25. This circuit bridge 130 is a non-conductive material, and is made from a material (second member) that is softer than the main plate 120 of the movement 110.

A "soft" material as used here means a material that is pliable to compression and tension, deforms slightly due to its pliability and elasticity, and is durable. Examples of such materials include POM (polyacetal) and PAR (polyarylate).

A donut-shaped storage space is formed by the movement 110, circuit bridge 130, dial ring 83, and inside surface of the case 80. The annular antenna 40 is housed in this space. The antenna 40 is therefore disposed on the inside side of the inside circumference of the bezel 82, and the top of the antenna 40 is covered by the dial ring 83.

An annular ground plane 90 made of metal is disposed in this space between the antenna 40 and the movement 110. The ground plane 90 is electrically connected to the body 81 through a spring (not shown in the figure) disposed to the ground plane 90, and because the back cover 85 is fixed to the body 81, the ground plane 90 is also electrically connected to the back cover 85.

More specifically, the ground plane 90 is electrically connected to the ground of the circuit board 25 through the path: ground plane 90->spring disposed to the ground plane 90->body 81->back cover 85->conductive spring 24->circuit board 25 ground. The antenna 40 is fit together with protrusions (not shown in the figure) formed on the top surface of the main plate 120 of the movement 110, thereby positioned horizontally and circumferentially to the movement 110, and prevented from rotating and shifting horizontally.

The antenna 40 has an antenna element made of metal or other conductive material formed by a plating or silver paste printing process, for example, on an annular base made of a dielectric material. The antenna 40 in this embodiment is disposed around the dial 11, housed on the inside circumference side of the bezel 82, and covered from above by the dial ring 83 and crystal 84.

The dielectric base of the antenna 40 is adjusted to a constant $\Sigma r$ of approximately 5-20 by mixing a dielectric material that is used in high frequency applications, such as titanium oxide, with resin. The wavelength shortening effect of the dielectric can thus be used to reduce the size of the antenna.

For example, the frequency of signals from GPS satellites 20 is 1.575 GHz, the length of one wave is approximately 19 cm, embedding a normal antenna of this size in the bezel of a wristwatch is not possible, and wavelength shortening is required. A dielectric with a constant $\Sigma r$ of 5-20 is therefore used in this embodiment to achieve a wavelength shortening rate of $(\cdot r)^{-1/2}$ in the dielectric base. The size of the antenna can therefore be reduced, and a 1-wavelength loop antenna can be fit in a wristwatch as an antenna for receiving GPS signals.

The antenna 40 is fed through a feed node, and a feed pin 44 disposed below the antenna is connected to this feed node. The feed pin 44 is a pin-shaped connector made of metal, is disposed to the top of the circuit board 25, passes through a through-hole formed in the main plate 120 of the movement 110 and enters the storage space, and connects the circuit board 25 with the antenna 40 inside this storage space.

Good reception performance can also be assured because the antenna 40 is located below the crystal 84. The freedom of design is also not impaired because the top of the antenna 40 is covered by the dial ring 83, the antenna 40 is therefore not exposed, and the top of the dial ring 83 can be designed as desired. The freedom of design of the dial 11 is also not impaired because the antenna 40 is located outside the dial 11.

As shown in FIG. 3B, an optically transparent dial 11, a solar panel 87 for solar power generation, a center pivot 12 passing through the dial 11, solar panel 87, and main plate 120 of the movement 110, and plural hands 13 (second hand 13*a*, minute hand 13*b*, hour hand 13*c*) that move around the center pivot 12 and display the current time, are disposed inside the inside circumference of the antenna 40.

The solar panel 87 is a round disc having plural solar cells (photovoltaic devices) that convert light energy to electrical energy (power) connected in series. The solar panel 87 is disposed inside the inside circumference of the antenna 40 and between the movement 110 and dial 11. A center hole through which the center pivot 12 passes is formed in the center of the solar panel 87.

The center pivot 12 extends in the direction between the face and back along the center axis of the case 80. The dial 11 is round and made of plastic or other optically transparent non-conductive material. As shown in FIG. 3A, the dial 11 is disposed between the crystal 84 and movement 110. A hole through which the center pivot 12 passes is formed in the center of the dial 11. The hands 13 are disposed between the crystal 84 and the dial 11 inside the inside circumference of the antenna 40.

A drive mechanism (drive unit) 30 that causes the center pivot 12 to turn and drives the plural hands 13 is disposed below (on the back cover side of) the main plate 120 of the movement 110 as shown in FIG. 3B. The drive mechanism 30 includes a stepper motor M and wheel train, and drives the hands 13 by the stepper motor M causing the center pivot 12 to turn through the wheel train. More specifically, the drive mechanism 30 causes the center pivot 12 to turn so that the hour hand 13*c* turns one revolution in 12 hours, the minute hand 13*b* turns one revolution in 60 minutes, and the secondhand 13*a* turns one revolution in 60 seconds.

The electronic timepiece 100 has a circuit board 25 inside the case 80. The circuit board 25 is made of resin or other material including a dielectric, and is disposed below the drive mechanism 30 (that is, between the drive mechanism 30 and the back cover 85).

A circuit block 21 including a GPS reception unit (radio receiver) 26 and control unit 70 is disposed on the bottom (on the surface facing the back of the wristwatch) of the circuit board 25. The GPS reception unit 26 is a single-chip IC module, for example, and includes analog and digital circuits. The control unit 70 sends control signals to the GPS reception unit 26 and controls the reception operation of the GPS reception unit 26, and controls operation of the drive mechanism 30.

A feed pin 44 made of metal or other conductive material is disposed to the top of the circuit board 25. The feed pin 44 has an internal spring, passes through the ground plane 90 and contacts the antenna 40, and passes through the main plate 120 of the movement 110 and contacts the circuit board 25. The feed means of the antenna 40 is therefore electrically connected to the circuit board 25 (more precisely, to wiring disposed to the circuit board 25) through the feed pin 44, and received signals are supplied from the antenna 40 to the circuit board 25.

The circuit block 21 including the GPS reception unit 26 and control unit 70 is covered by a member made of a conductive material with a shield effect, and is electrically connected to the ground plane 90 through a circuit support 39, the back cover 85, and the body 81. Ground potential is supplied through a conductive spring 24 to the circuit block 21. More specifically, the circuit support 39, back cover 85, body 81, and ground plane 90 are held at the ground potential of the circuit block, and function as a ground plane.

The magnetic screens S1 and S2 are disposed between the drive mechanism 30 and the main plate 120, and another magnetic screen S3 is disposed between the drive mechanism 30 and circuit board 25. Magnetic screens S1 and S2 are referred to below as a first magnetic screen, and magnetic screen S3 as a second magnetic screen. Magnetic screens S1 to S3 are made of a conductive material with high permeability, such as pure iron.

If there is a speaker or other object that produces a strong magnetic field on the outside of the electronic timepiece 100, the magnetic field can cause the stepper motors M to operate incorrectly. Of the parts of the electronic timepiece 100, metal in the body 81 and back cover 85 produces a magnetic field when magnetized. Circuit blocks 21 on the circuit board 25 can also produce a magnetic field.

By covering the stepper motors M with magnetic screens S1 to S3 made of a high permeability material, this embodiment of the invention magnetically shields the drive mechanism 30 and prevents the stepper motor M from operating incorrectly due to the magnetic fields described above.

A lithium ion battery or other cylindrically shaped storage battery 27, and a battery compartment 28 for holding the storage battery 27, are also disposed inside the case 80 of the electronic timepiece 100.

The storage battery 27 is charged by the power produced by the solar panel 87. The battery compartment 28 for holding the storage battery 27 is below the circuit board 25 (that is, between the circuit board 25 and back cover 85).

The crown 16 and pushers 17, 18 (FIG. 2) are disposed on the outside of the case 80. Movement of the crown 16 resulting from the user of the electronic timepiece 100 operating the crown 16 is transferred through the stem 16*a* passing through the case 80 to the drive mechanism 30. Movement of the pusher 17 (or 18) produced by the user of the electronic timepiece 100 pressing the pusher 17 (or 18) is transferred to a switch not shown through the corresponding button stem passing through the case 80. These switches convert pressure from the pusher 17 (or pusher 18) to an electrical signal, and output the signal to the control unit 70.

B. Circuit Configuration of the Electronic Timepiece with Internal Antenna

Figure 5:
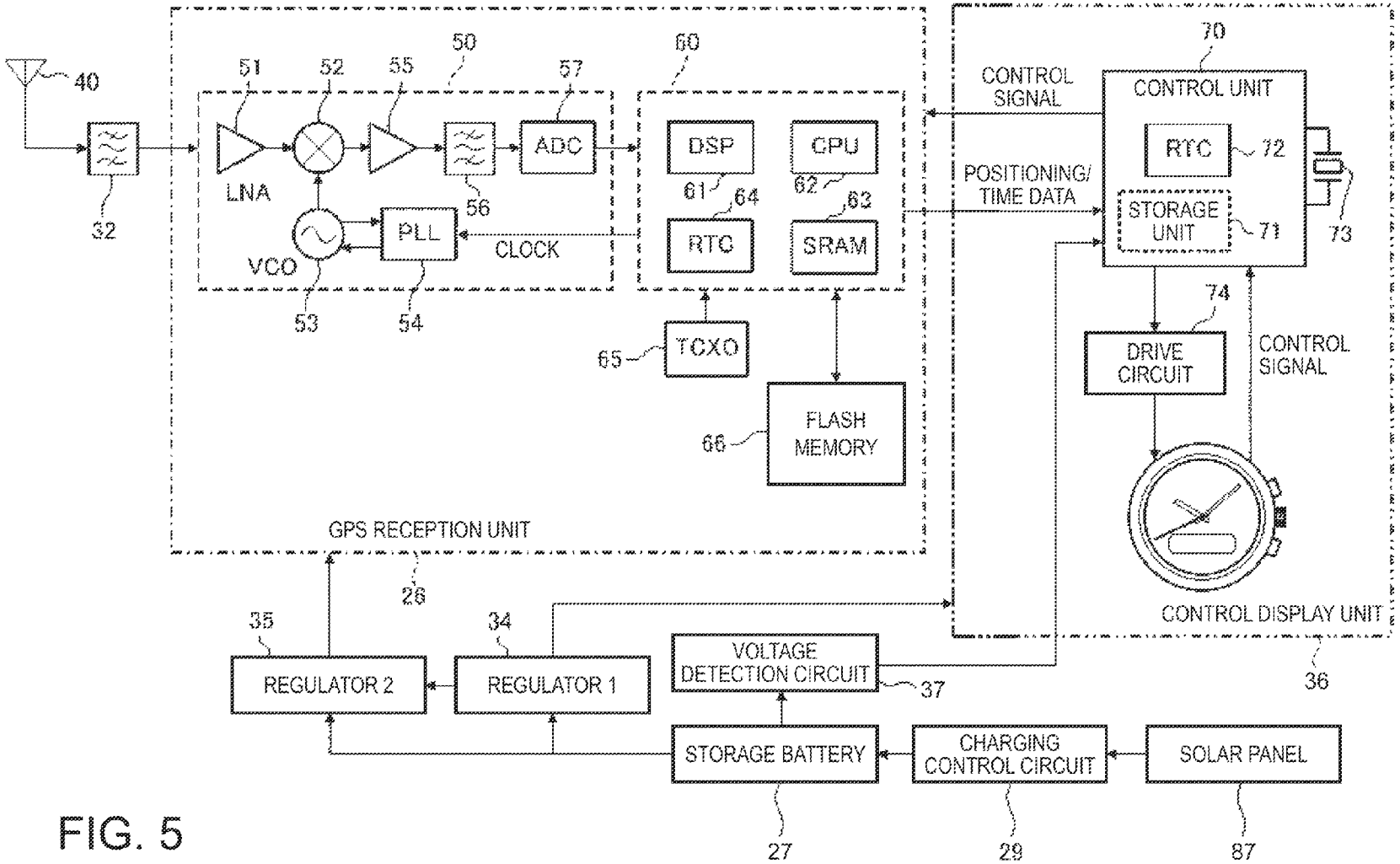
FIG. 5 is a block diagram showing the circuit configuration of the electronic timepiece 100.

FIG. 5 is a block diagram showing the circuit configuration of the electronic timepiece 100.

As shown in FIG. 5, the electronic timepiece 100 includes a GPS reception unit 26 and a control display unit 36. The GPS reception unit 26 executes processes related to receiving satellite signals, locking onto GPS satellites 20, generating positioning information, and generating time correction information, for example. The control display unit 36 executes processes including keeping the internal time and adjusting the internal time.

A solar panel 87 charges the storage battery 27 through the charging control circuit 29.

The electronic timepiece 100 has regulators 34 and 35, and the storage battery 27 supplies drive power through a regulator 34 to the control display unit 36, and supplies drive power through another regulator 35 to the GPS reception unit 26.

The electronic timepiece 100 also has a voltage detection circuit 37 that detects the voltage of the storage battery 27.

Regulator 35 could be split into a regulator 35-1 (not shown) that supplies drive power to the RF unit 50 (described below), and a regulator 35-2 (not shown) that supplies drive power to a baseband unit 60 (described below). In this implementation, regulator 35-1 could be disposed in the RF unit 50.

The electronic timepiece 100 also has the antenna 40 described above and a SAW (surface acoustic wave) filter 32. As described with reference to FIG. 1, the antenna 40 receives satellite signals from plural GPS satellites 20. However, because the antenna 40 also receives noise in addition to the satellite signals, the SAW filter 32 extracts the satellite signals from the signals received by the antenna 40. In other words, the SAW filter 32 functions as a bandpass filter that passes signals in the 1.5 GHz waveband.

The GPS reception unit 26 includes the RF (radio frequency) unit 50 and baseband unit 60. As described below, the GPS reception unit 26 executes a process that extracts satellite information including GPS time information and orbit information contained in the navigation message from the 1.5 GHz satellite signal extracted by the SAW filter 32.

The RF unit 50 includes a LNA (low noise amplifier) 51, mixer 52, VCO (voltage controlled oscillator) 53, PLL (phase-locked loop) circuit 54, IF (intermediate frequency) amplifier 55, IF filter 56, and A/D converter 57.

The satellite signal passed by the SAW filter 32 is amplified by the LNA 51. The satellite signal amplified by the LNA 51 is mixed by the mixer 52 with the clock signal output by the VCO 53, and down-converted to a signal in the intermediate frequency band. The PLL circuit 54 phase compares a clock signal obtained by frequency dividing the output clock signal of the VCO 53 with a reference clock signal, and synchronizes the output clock signal of the VCO 53 to the reference clock signal. As a result, the VCO 53 can output a stable clock signal with the frequency precision of the reference clock signal. Note that several megahertz, for example, can be selected as the intermediate frequency.

The signal from the mixer 52 is amplified by the IF amplifier 55. However, mixing by the mixer 52 also produces a high frequency component of several GHz in addition to the IF signal. The IF amplifier 55 therefore amplifies both the IF signal and the high frequency component of several GHz. The IF filter 56 therefore passes the IF signal and removes the high frequency component of several GHz (more accurately, attenuates the signal to a specific level or less). The IF signal passed by the IF filter 56 is converted to a digital signal by the A/D converter 57.

The baseband unit 60 includes, for example, a DSP (digital signal processor) 61, CPU (central processing unit) 62, SRAM (static random access memory) 63, and RTC (real-time clock) 64. A TCXO (temperature compensated crystal oscillator) 65 and flash memory 66 are also connected to the baseband unit 60.

The temperature compensated crystal oscillator (TCXO) 65 generates a reference clock signal of a substantially constant frequency regardless of temperature. Time zone information, for example, is stored in flash memory 66. The time zone information defines the time difference between the current location and UTC based on specific coordinates (such as latitude and longitude).

The baseband unit 60 executes a process that demodulates the baseband signal from the digital signal (IF signal) output from the A/D converter 57 of the RF unit 50 when set to the time information acquisition mode or the positioning information acquisition mode.

In addition, when the time information acquisition mode or the positioning information acquisition mode is set, the baseband unit 60 executes a process that generates a local code of the same pattern as each C/A code, and correlates the local codes to the C/A code contained in the baseband signal, in the satellite search step. The baseband unit 60 adjusts the timing when the local code is generated to find the peak correlation to each local code, and when the correlation equals or exceeds a threshold value, confirms synchronization with the GPS satellite 20 matching the local code (that is, confirms locking onto a GPS satellite 20). Note that the GPS system uses a CDMA (Code Division Multiple Access) method whereby all GPS satellites 20 transmit satellite signals on the same frequency using different C/A codes. The GPS satellites 20 that can be locked onto can therefore be found by identifying the C/A code contained in the received satellite signal.

To acquire the satellite information from the satellite signal of the GPS satellite 20 that was locked onto in the time information acquisition mode or the positioning information acquisition mode, the baseband unit 60 executes a process that mixes the baseband signal with the local code of the same pattern as the C/A code of the GPS satellite 20 that was locked.

The navigation message containing the satellite information of the GPS satellite 20 that was locked onto is demodulated in the mixed signal. The baseband unit 60 then executes a process to detect the TLM word (preamble data) of each subframe in the navigation message, and acquire (such as store in SRAM 63) satellite information such as the orbit information and GPS time information contained in each subframe. The GPS time information as used here is the week number (WN) and Z count, but the Z count data alone could be acquired if the week number was previously acquired. The baseband unit 60 then generates the time adjustment information required to correct the internal time based on the satellite information.

In the time information acquisition mode, the baseband unit 60 more specifically calculates the time based on the GPS time information, and generates time correction information. The time correction information in the time information acquisition mode may be the GPS time information, or information about the time difference between the GPS time and internal time.

However, in the positioning information acquisition mode, the baseband unit 60 more specifically calculates the position based on the GPS time information and orbit information, and acquires the location information (more specifically calculates the latitude and longitude of the electronic timepiece 100 when the satellite signals were received).

Next, the baseband unit 60 references the time difference (time zone) information stored in flash memory 66, and acquires the time difference at the coordinates (such as latitude and longitude) of the electronic timepiece 100 determined from the positioning information. The baseband unit 60 thus generates satellite time data (GPS time information) and time zone (time difference) data as the time correction information. The time correction information used in the positioning information acquisition mode may thus be the GPS time information and time zone information as described above, but the time difference between the internal time and the GPS time could be used instead of the GPS time information.

Note that the baseband unit 60 can generate the time correction information using the GPS time information from one GPS satellite 20, or the baseband unit 60 can generate the time correction information from satellite information from a plurality of GPS satellites 20.

Operation of the baseband unit 60 is synchronized to the reference clock signal output by the TCXO 65. The RTC 64 generates the timing for satellite signal processing, and counts up at the reference clock signal output from the TCXO 65.

The control display unit 36 includes a control unit 70, crystal oscillator 73, and drive circuit 74.

The control unit 70 includes a storage unit 71 and a RTC (real-time clock) 72, and controls various operations. The control unit 70 can be rendered with a CPU, for example. The control unit 70 outputs control signals to the GPS reception unit 26, and controls reception by the GPS reception unit 26. The control unit 70 also controls operation of regulators 34, 35 based on output from the voltage detection circuit 37. The control unit 70 also controls movement of the hands 13 through the drive circuit 74.

Received data is stored in the storage unit 71. The control unit 70 adjusts the internal time based on the received data. The internal time is the time kept in the electronic timepiece 100 by the RTC 72. The RTC 72 operates continuously, and counts up at the reference clock signal generated by the crystal oscillator 73. The control unit 70 can therefore update the internal time and continue moving the hands even when power is not supplied to the GPS reception unit 26.

When the time information acquisition mode is set, the control unit 70 controls operation of the GPS reception unit 26, corrects the internal time based on the GPS time, and stores the time in the storage unit 71. More specifically, the internal time is corrected to UTC (Coordinated Universal Time) by adding a UTC offset to the acquired GPS time.

When the positioning information acquisition mode is set, the control unit 70 controls operation of the GPS reception unit 26, corrects the internal time based on the satellite time data (GPS time) and time zone (time difference) data, and stores the time in the storage unit 71.

C. Fastening Structure of the Electronic Timepiece with Internal Antenna

Figure 6:
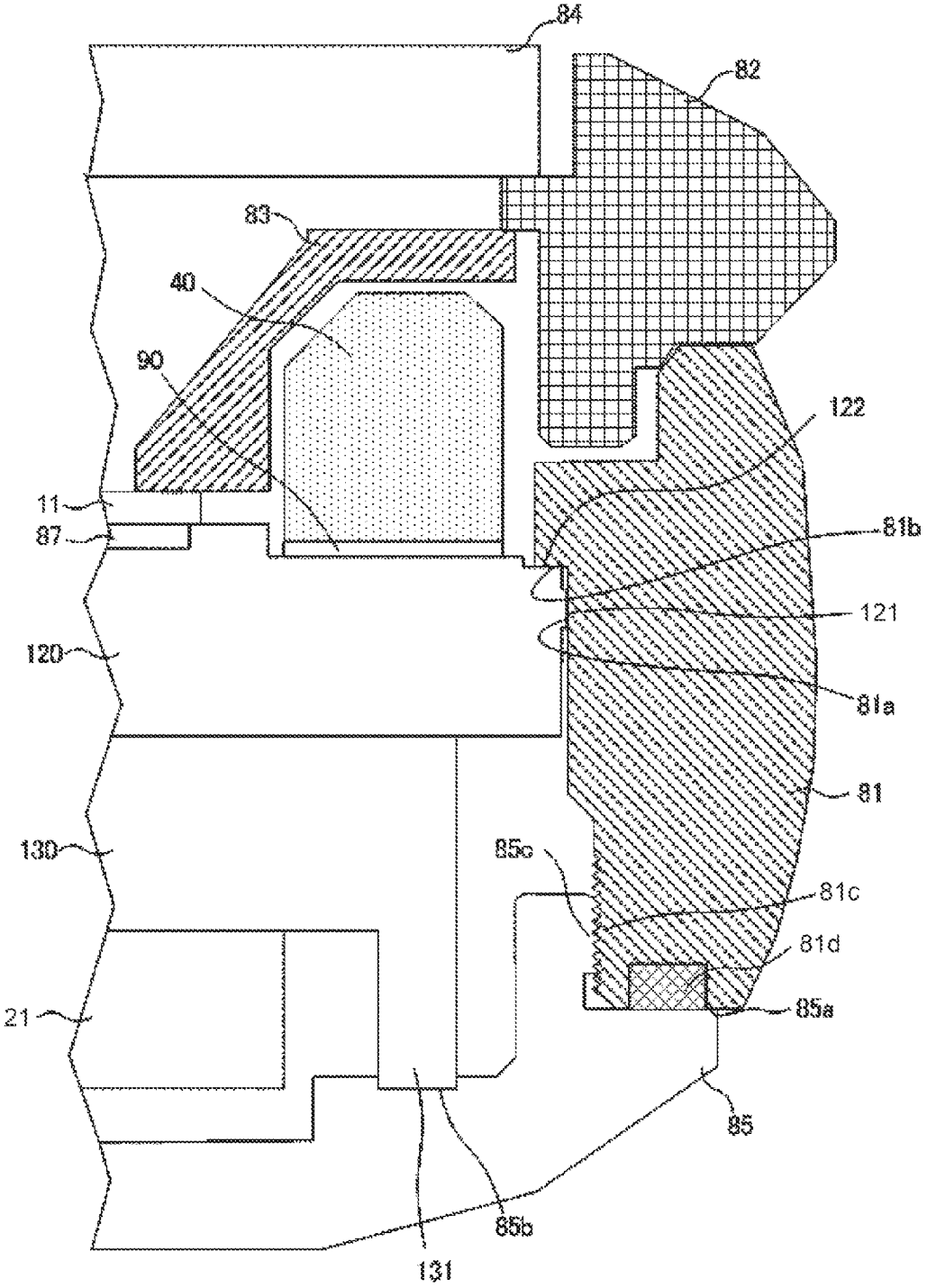
FIG. 6 is a partial section view showing the structure that fixes the movement to the outside case of the electronic timepiece 100.
Figures 7A, 7B:
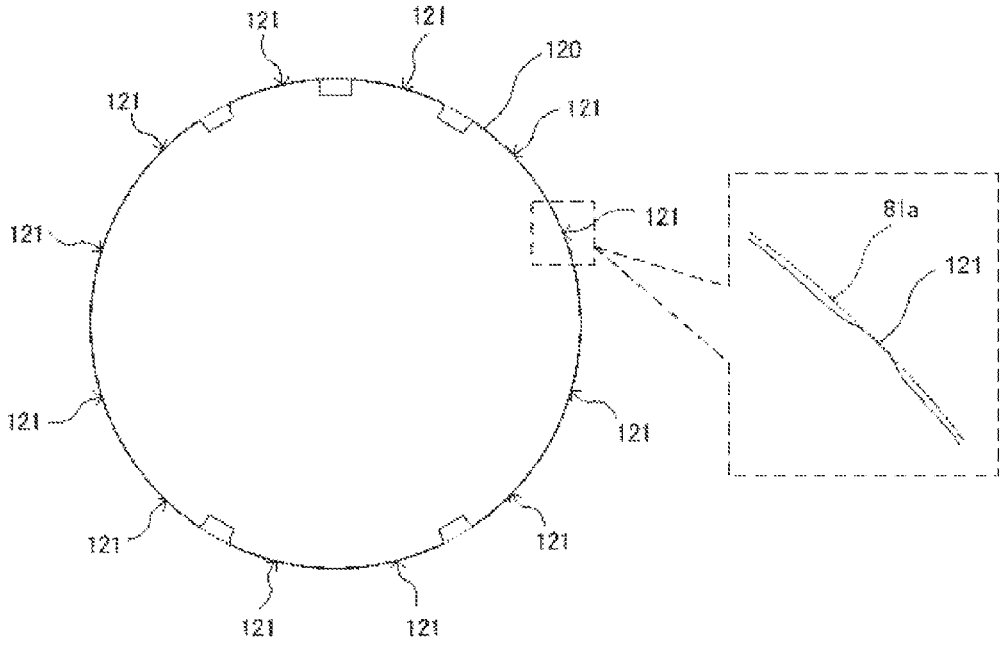
FIG. 7A is a top view showing where pressure is applied between the horizontal positioning surface 81*a* and the movement engaging parts 121 on the outside circumference of the movement in the electronic timepiece 100.
FIG. 7B is an enlarged view of part of FIG. 7A.
Figures 8A, 8B:
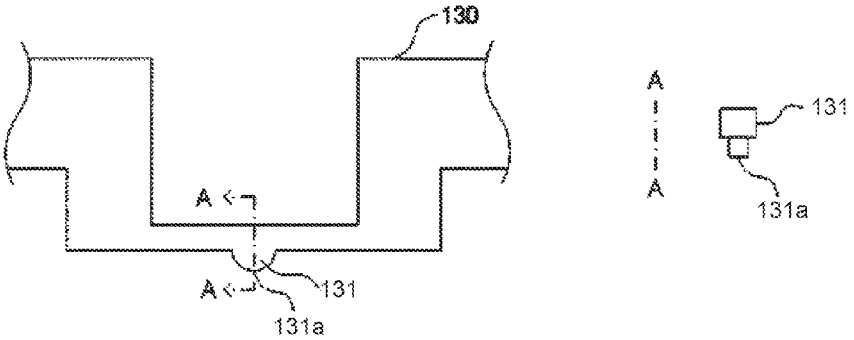
FIG. 8A is a side view showing the upward pressure part 131 of the electronic timepiece 100.
FIG. 8B is a section view through A-A in FIG. 8A.

The fastening structure of the electronic timepiece 100 according to this embodiment of the invention is described next. FIG. 6 is a section view of part of the movement and outside case fastening structure of the electronic timepiece 100. FIG. 7A is a top view showing contact between the movement engaging parts 121 and the horizontal positioning surface 81*a* of the electronic timepiece 100, and FIG. 7B is an enlarged view of part of FIG. 7A. FIG. 8A is a side view showing the upward pressure part 131 of the electronic timepiece 100, and FIG. 8B is a section view through line A-A in FIG. 8A.

The structure for fastening the back cover 85 to the body 81 is described first. As shown in FIG. 6, a horizontal engagement part 85*c*, which is a thread that is screwed to the body 81, and a vertical engagement part 85*a* that contacts and vertically positions and fixes the back cover 85 to the body 81, are formed around the outside circumference of the back cover 85. A screw thread 81*c* that threads together with the horizontal engagement part 85*c*, and packing 81*d* that is vertically compressed to form a seal with the vertical engagement part 85*a*, are disposed to the body 81.

This construction horizontally positions the back cover 85 to the body 81 by screwing the horizontal engagement part 85*c* and the screw thread 81*c* together. The back cover 85 is also vertically positioned to the body 81 by the vertical engagement part 85*a* sealing against the packing 81*d*.

The structure for horizontally fastening the movement 110 to the body 81 is described next. As shown in FIG. 6, the body 81 has a horizontal positioning surface 81*a* formed on the inside surface of the body 81. Plural movement engaging parts 121 are formed on the outside circumference surface of the main plate 120 of the movement 110. As shown in FIG. 7A and FIG. 7B, these movement engaging parts 121 are pressed against the horizontal positioning surface 81*a* and horizontally position the main plate 120 to the body 81.

When the movement 110 is placed inside the body 81, the movement engaging parts 121 in this configuration are pressed by the horizontal positioning surface 81*a*, and the movement engaging parts 121 are pushed to the outside. As a result, the movement 110 is horizontally positioned to the body 81.

The structure for vertically fastening the movement 110 to the body 81 is described next. As shown in FIG. 6, a vertical positioning surface 81*b* that protrudes radially to the inside of the body 81 is disposed on the inside surface on the time display unit side of the body 81. A movement top positioning part 122 that is pushed against the vertical positioning surface 81*b* and vertically positions the movement 110 to the body 81 is disposed to the main plate 120 of the movement 110.

An upward pressure part 131 pushes the movement 110 to the face side of the timepiece in this embodiment of the invention. More specifically, the upward pressure part 131 is formed on the circuit bridge 130 on the bottom of the movement 110, and protrudes toward the back cover 85 as shown in FIG. 6. A pressure channel 85*b* that engages the upward pressure part 131 is disposed to the back cover 85 at a position opposite the upward pressure part 131. As shown in FIG. 8A and FIG. 8B, the upward pressure part 131 has a protruding part 131*a* that protrudes down, and when the back cover 85 is screwed onto the body 81 with the movement 110 housed inside, the upward pressure part 131 fits into the pressure channel 85*b*.

D. Benefit of the Embodiment

This embodiment of the invention positions the antenna 40 horizontally to the movement 110. By fitting the case 80 over the movement 110 on the back cover 85, reaction from the back cover 85 is applied to the movement 110, the movement 110 is vertically positioned and fixed to the case 80 by the movement top positioning part 122 of the movement 110 and the upward pressure part 131 of the circuit bridge 130, the movement 110 is horizontally positioned to the case 80 by the movement engaging parts 121 of the movement 110, and the antenna 40 is thus also horizontally and vertically positioned and fixed relative to the case 80. As a result, the distance between the antenna 40 and case 80 can be held constant, the effect of the case 80 can be made constant, and good antenna reception performance can be maintained.

Because the upward pressure part 131 of the circuit bridge 130 disposed on the back cover 85 side is made of a softer material than the main plate 120 of the movement 110 in this embodiment, the upward pressure part 131 deforms slightly due to its pliability and elasticity, absorbs pressure, and is not damaged even when compressed and extreme pressure is applied from the back cover 85. The movement top positioning part 122 also contacts the vertical positioning surface 81*b* of the case, and the movement 110 is vertically positioned to the body 81, due to the reaction from the back cover 85 transmitted to the main plate 120 of the movement 110.

Furthermore, because the main plate 120 of the movement 110 is made from a hard material, the drive mechanism 30 and other parts stored inside can be protected, and the movement can be pushed to the body 81 side and appropriately secured. This embodiment also does not require a separate member to secure the movement, the parts count is therefore reduced, and a larger space is not required to hold the movement.

Embodiment 2

A second embodiment of the invention is described below with reference to FIG. 9 to FIG. 13. The first embodiment describes holding a constant distance between the antenna 40 and case 80. This second embodiment describes holding the antenna 40 in a constant position relative to the dial ring 83. Further detailed description of like parts in this and the first embodiment is omitted while the differences with the first embodiment are described below.

A. Mechanical Configuration of an Electronic Timepiece with Internal Antenna FIG. 9 is a side view showing the internal structure of the electronic timepiece 200 according to this embodiment of the invention, and FIG. 10 is an exploded oblique view showing parts of the electronic timepiece 200.

Figure 9:
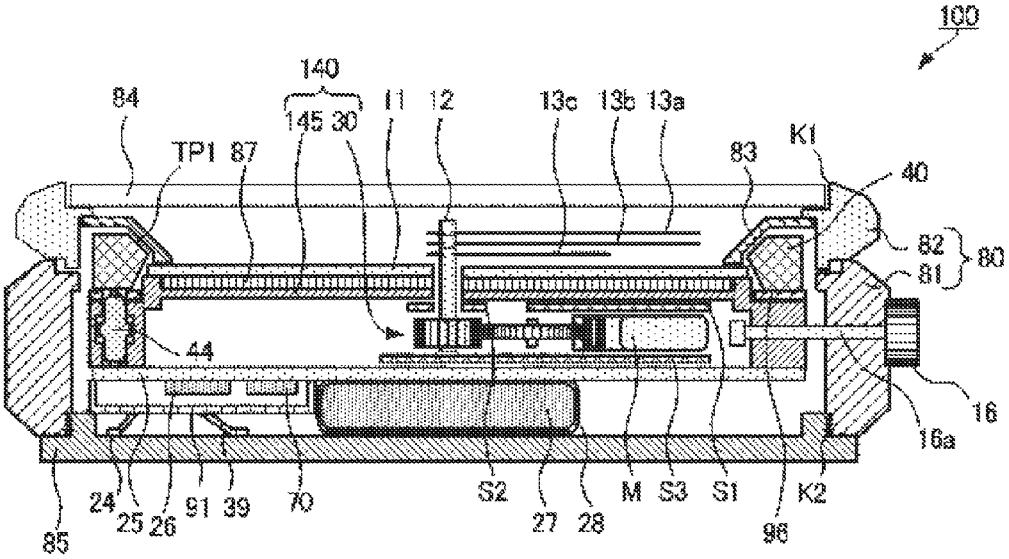
FIG. 9 is a partial section view of the electronic timepiece 200 with internal antenna according to a second embodiment of the invention.
Figure 10:
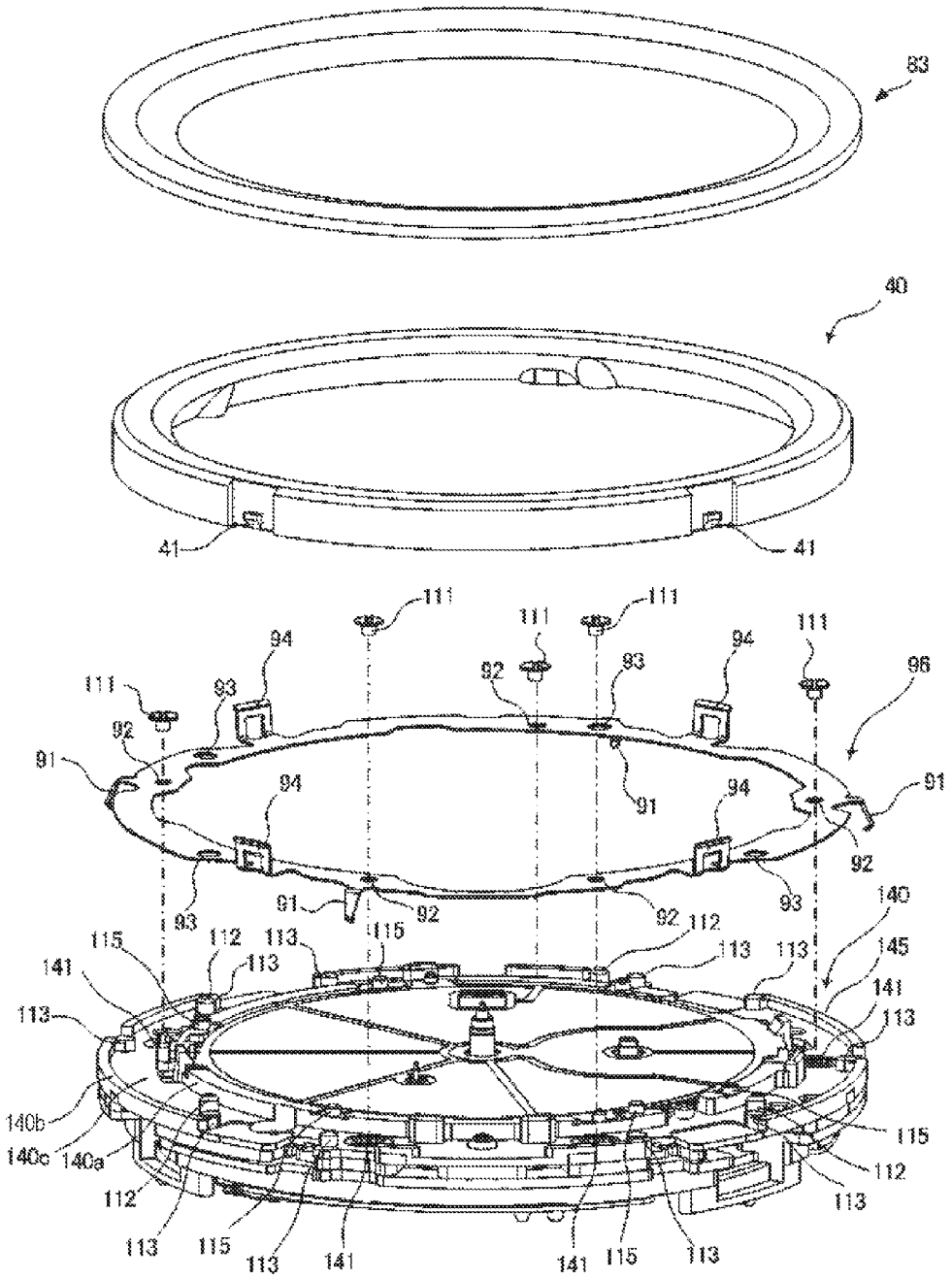
FIG. 10 is an exploded view of part of the electronic timepiece 200.

As shown in FIG. 9, a ring-shaped dial ring 83 made of plastic or other non-conductive material is disposed to the inside circumference of the bezel 82 below (on the back cover side of) the crystal 84. A movement 140 with a main plate 145 made of plastic or other non-conductive material is disposed inside the inside circumference of the body 81 below the dial ring 83.

The movement 140 includes the drive mechanism 30 and the main plate 145 that holds the drive mechanism 30. As shown in FIG. 9, the movement 140 is fit to the inside of the case 80 and has hands 13 disposed on the time display unit (face) side. The main plate 145 of the movement 140 is a member made from a hard material (first member) that is non-conductive and has a constant strength.

A "hard" material as used here means a material with little deformation to compression and tension, and includes plastics such as PPS (polyphenylene sulfide), PTES (polythioethersulfone), PC (polycarbonate), LCP (liquid crystal polymer), and PA (polyamide).

A donut-shaped storage space is formed by the movement 140, dial ring 83, and inside surface of the case 80. More specifically, the outside circumference side of the dial ring 83 is a flat ring-shaped part that contacts the inside surface of the bezel 82, and the inside circumference side of the dial ring 83 is a bowl-shaped part that slopes to the inside. This donut-shaped storage space is formed by the ring-shaped part and the bowl-shaped parts of the dial ring 83, and the inside circumference of the case 80. The annular antenna 40 is housed in this space. In this embodiment, the dial ring 83 functions as the top member that covers the antenna 40.

The antenna 40 is therefore disposed on the inside side of the inside circumference of the bezel 82, and the top of the antenna 40 is covered by the dial ring 83.

An annular ground plane 96 made of metal is disposed in this space between the antenna 40 and the movement 140. The ground plane 96 is electrically connected to the back cover 85 through a conductive spring 24, and because the back cover 85 is fixed to the body 81, the ground plane 96 is also electrically connected to the body 81.

The antenna 40 has an antenna element made of metal or other conductive material formed by a plating or silver paste printing process, for example, on an annular base made of a dielectric material. The antenna 40 in this embodiment is disposed around the dial 11, housed on the inside circumference side of the bezel 82, and covered from above by the dial ring 83 and crystal 84.

A slope TP1 that inclines at the same angle as the bowl-shaped part of the dial ring 83 is disposed to the antenna 40. This slope TP1 is formed contiguously to the top and sloping toward the dial 11 so that the height to the dial 11 decreases to the inside (toward the center pivot 12).

As in the first embodiment, the dielectric base of the antenna 40 is adjusted to a constant ·r of approximately 5-20 by mixing a dielectric material that is used in high frequency applications, such as titanium oxide, with resin. The wavelength shortening effect of the dielectric can thus be used to reduce the size of the antenna. This feature is the same as in the first embodiment, and further detailed description thereof is thus omitted.

The antenna 40 is fed through a feed node, and a feed pin 44 disposed below the antenna is connected to this feed node. The feed pin 44 is a pin-shaped connector made of metal, is disposed to the top of the circuit board 25, passes through a through-hole formed in the main plate 145 of the movement 140 and enters the storage space, and connects the circuit board 25 with the antenna 40 inside this storage space.

The circuit configuration of this electronic timepiece 200 is identical to the circuit configuration of the first embodiment shown in FIG. 5, and further description thereof is omitted.

B. Attaching the Antenna and Dial Ring to an Electronic Timepiece with Internal Antenna The method of attaching the antenna 40 and dial ring 83 in this embodiment is described next. As shown in FIG. 10, the movement 140 in this embodiment has an antenna compartment 140*c* between an inside circumference wall 140*a* and an outside circumference wall 140*b*. A ring-shaped ground plane 96 made of metal is disposed as an urging member in this antenna compartment 140*c*, and the antenna 40 is secured in the movement 140 by engaging the ground plane 96 and the antenna 40.

Antenna studs 112 are formed as antenna engagement parts protruding vertically from four locations on the main plate 145 of the movement 140, and plural through-holes 93 through which these antenna studs 112 pass are formed in the ground plane 96. By inserting these antenna studs 112 in these through-holes 93, the ground plane 96 is positioned in the plane direction and circumferentially to the main plate 145 of the movement 140.

As also shown in FIG. 10, four conductive parts 91 are formed around the outside of the ground plane 96, and these conductive parts 91 are configured to contact the inside of the case 80.

Five screws 111 are then screwed into five screw holes 141 formed in the main plate 145 of the movement 140 through plural through-holes 92 formed in the ground plane 96, firmly fastening the ground plane 96 to the main plate 145 of the movement 140. The ground plane 96 in this embodiment is thus fixed in contact with the main plate 145 of the movement 140 at selected places by the plural screws 111 instead of the entire surface of the ground plane 96 being held in contact with the antenna compartment 140*c*.

Cavities that receive the antenna studs 112 described above are formed in the bottom of the antenna 40, and the antenna 40 is positioned in the plane direction and circumferentially to the movement 140 by fitting the antenna studs 112 formed in the main plate 145 of the movement 140 in these cavities in the antenna 40.

Dial ring studs 115 are formed at plural places on the main plate 145 as top member engaging parts that protrude vertically from the surface of the main plate 145 of the movement 140 on the inside circumference side of the antenna studs 112. Dial ring cavities are formed in the bottom of the dial ring 83 as top member cavities that engage the dial ring studs 115 described above. The dial ring 83 is positioned in the plane direction and circumferentially to the movement 140 by fitting the dial ring studs 115 on the main plate 145 into the dial ring cavities in the dial ring 83. Similar cavities can also be formed in the movement with matching protrusions formed on the antenna and dial ring.

The ground plane 96 also has four hooks 94, and matching claw-like protrusions 41 are formed on the antenna 40 as catches that engage the hooks 94. Plural pedestals 113 are also formed on the main plate 145 as reference surfaces for positioning the antenna 40 vertically.

Therefore, if the antenna 40 is installed so that the antenna studs 112 on the main plate 145 engage the cavities in the antenna 40 after the ground plane 96 is attached to the main plate 145, the antenna 40 will contact the pedestals 113 at plural places. When the hooks 94 of the ground plane 96 are then engaged with the claw-like protrusions 41 formed on the antenna 40, the antenna 40 is urged toward the main plate 145 by the elasticity of the ground plane 96, and pushed against the pedestals 113. The antenna 40 is thus reliably positioned vertically against the surface of the main plate 145.

As shown in FIG. 10, the positions where the hooks 94 and protrusions 41 engage, and the positions where the ground plane 90 is attached to the main plate 145 by the screws 111, are set to specific intervals circumferentially around the main plate 145. This enables imparting flexibility to the ground plane 96 so that when the antenna 40 is displaced by vibration, for example, the antenna 40 can be returned to its original position by the elasticity of the ground plane 96. This is further described below.

C. Positioning the Antenna in the Electronic Timepiece with Internal Antenna The configuration for positioning the antenna 40 in the electronic timepiece 200 according to this embodiment of the invention is described next.

As shown in FIG. 10, the electronic timepiece 200 according to this embodiment of the invention has a movement 140, a ring-shaped ground plane 96 made of metal, an antenna 40, and a dial ring 83. The ground plane 96 has conductive parts 91 that project below the ground plane 96 at four places around the circumference.

An antenna compartment 140*c* enclosed between an inside circumference wall 140*a* and outside circumference wall 140*b* is formed in the main plate 145 of the movement 140. To attach the ground plane 96 to the main plate 145, the antenna studs 112 formed to the main plate 145 are first passed through the through-holes 93 in the ground plane 96, and the ground plane 96 is then placed in the antenna compartment 140*c*. By inserting the antenna studs 112 to the through-holes 93, the ground plane 96 is positioned in the plane direction and circumferentially to the movement 140. The conductive parts 91 contact the inside of the case 80, and provide conductivity to the metal case 80.

Five screw holes 141 are formed in the main plate 145, and through-holes 92 are formed in the ground plane 96 at positions corresponding to the screw holes 141. The through-holes 92 in the ground plane 96 are aligned with the screw holes 141 in the main plate 145 when the ground plane 96 is set provisionally to the main plate 145. The plural screws 111 are then screwed into the screw holes 141, and the ground plane 96 is firmly fastened to the main plate 145. When the ground plane 96 is thus attached to the main plate 145, the antenna studs 112 pass through the through-holes 93 and protrude vertically to the surface of the main plate 145 as shown in FIG. 11.

Figure 11:
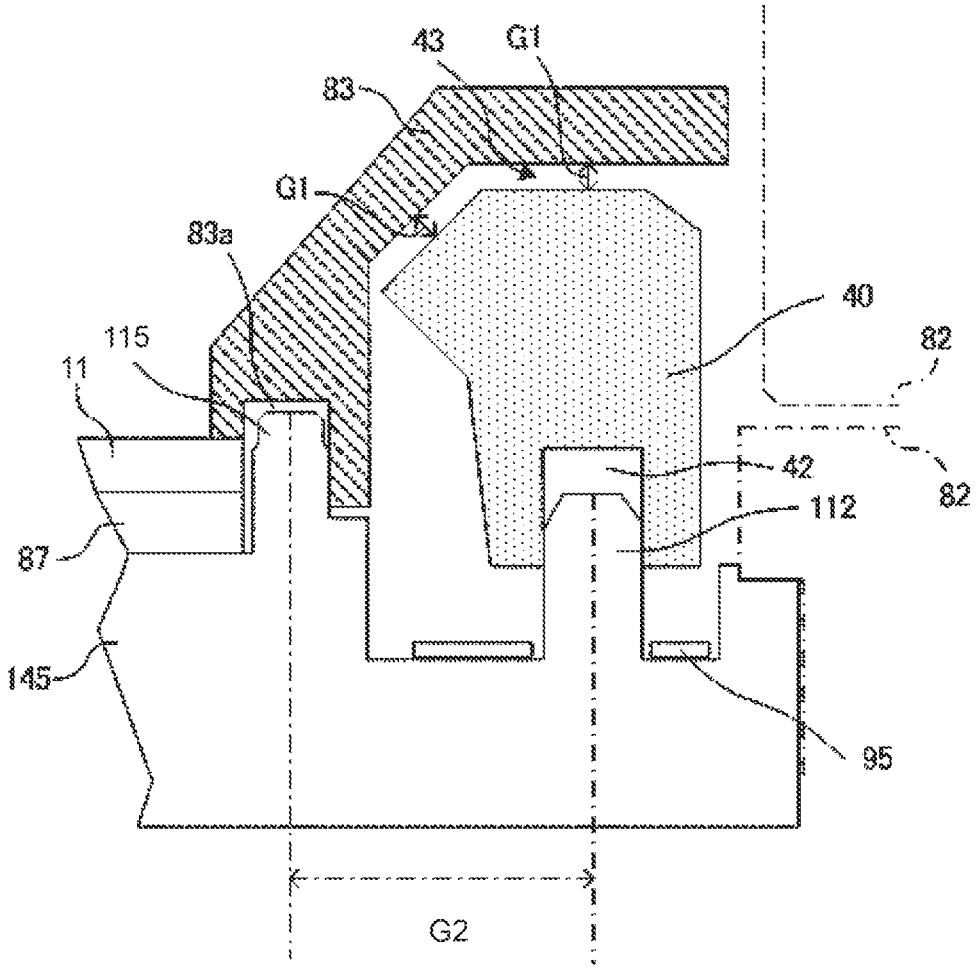
FIG. 11 is a partial section view showing engagement of the antenna element and dial ring of the electronic timepiece 200 with protrusions formed on the main plate of the movement.

Antenna cavities 42 that engage the antenna studs 112 are formed in the bottom of the antenna 40 as shown in FIG. 11. When the antenna 40 is installed, the antenna studs 112 formed on the main plate 145 are engaged with the antenna cavities 42 in the antenna 40.

The antenna studs 112 are cylindrical columns as shown in FIG. 10, and the corresponding antenna cavities 42 in the antenna 40 are cylindrical holes. Therefore, by fitting the antenna studs 112 of the main plate 145 in the antenna cavities 42 of the antenna 40, the antenna 40 is positioned in the plane direction to the main plate 145, and the center of the movement 140 is aligned with the virtual center of the antenna 40.

The antenna 40 is also positioned circumferentially to the main plate 145 by fitting the antenna studs 112 in the antenna cavities 42. As a result, the antenna 40 is positioned in the plane direction and circumferentially to the main plate 145.

The ground plane 96 also has hooks 94 that project up from the ground plane 96 at four locations. As shown in FIG. 12B, each hook 94 has a through-hole 95. Claw-like protrusions 41 are also formed to the antenna 40 at positions corresponding to the hooks 94 as shown in FIG. 12A.

As shown in FIG. 10, the main plate 145 has plural pedestals 113 as reference surfaces for vertically positioning the antenna 40 to the main plate 145. The pedestals 113 are substantially round, and the top is parallel to the surface of the main plate 145. The top of each pedestal 113 is at the same height relative to the surface of the main plate 145.

Figure 12A:
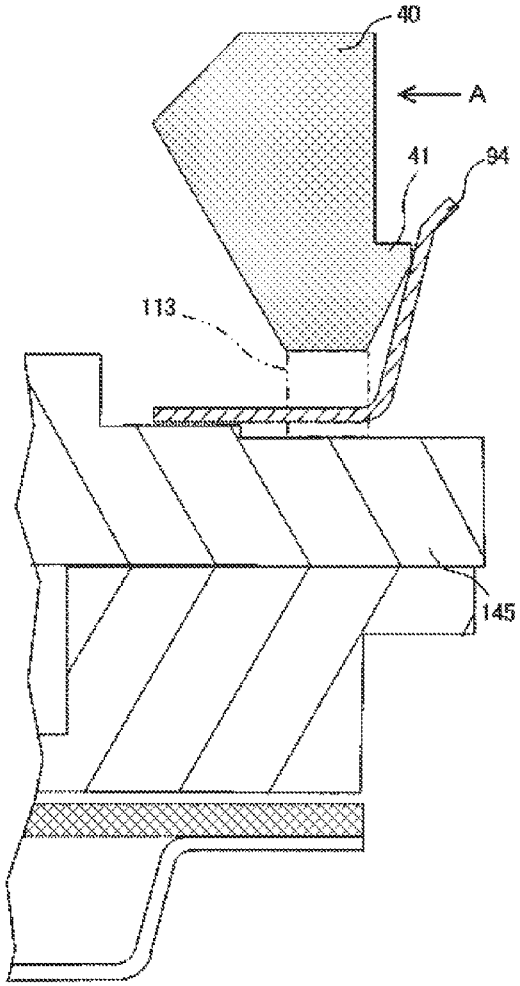
FIG. 12A and FIG. 12B are partial section views showing the vertical positioning part of the antenna element of the electronic timepiece 200.
Figure 12B:
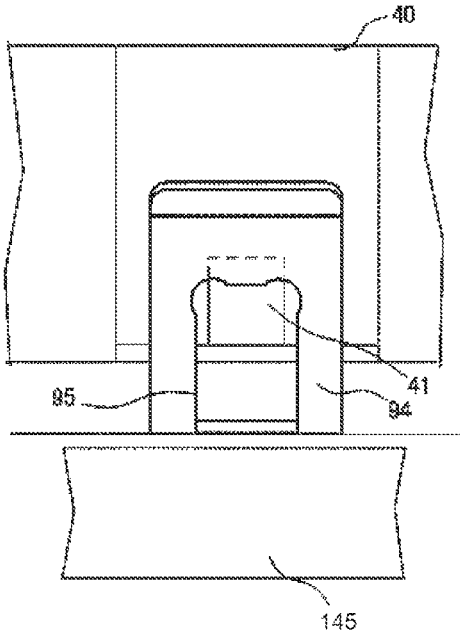

Therefore, after the ground plane 96 is attached to the main plate 145, and the antenna 40 is installed so that the antenna studs 112 of the main plate 145 engage the antenna cavities 42 of the antenna 40, the bottom of the antenna 40 contacts the tops of the plural pedestals 113 as shown in FIG. 12A.

FIG. 12A shows the antenna 40, a hook 94 of the ground plane 96, and the main plate 145 in section, and FIG. 12B is a view from the direction of arrow A in FIG. 12A. As shown in FIG. 12A and FIG. 12B, when the antenna 40 is placed on the pedestals 113, the through-holes 95 in the hooks 94 are not engaged with the protrusions 41 of the antenna 40.

Figure 13A:
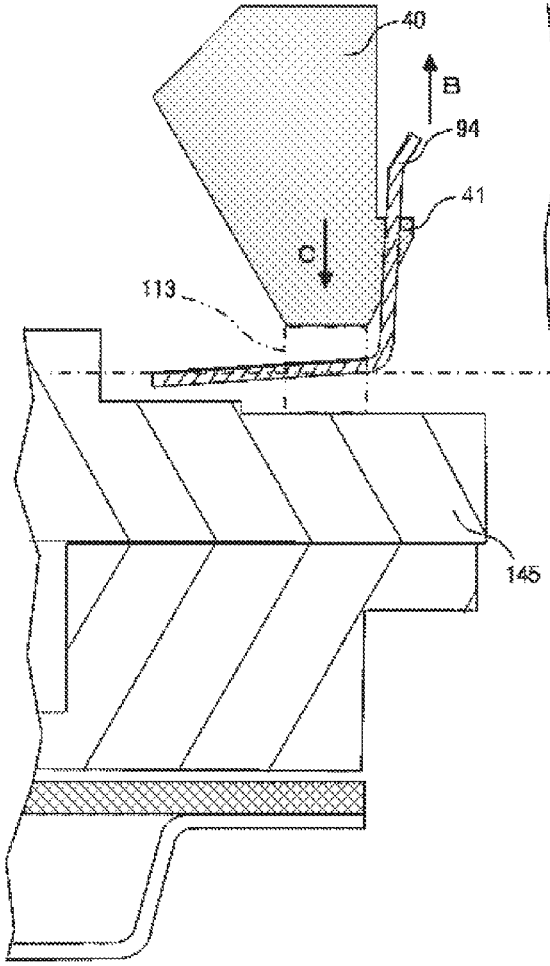
FIG. 13A and FIG. 13B are partial section views showing the vertical positioning part of the antenna element of the electronic timepiece 200.
Figure 13B:
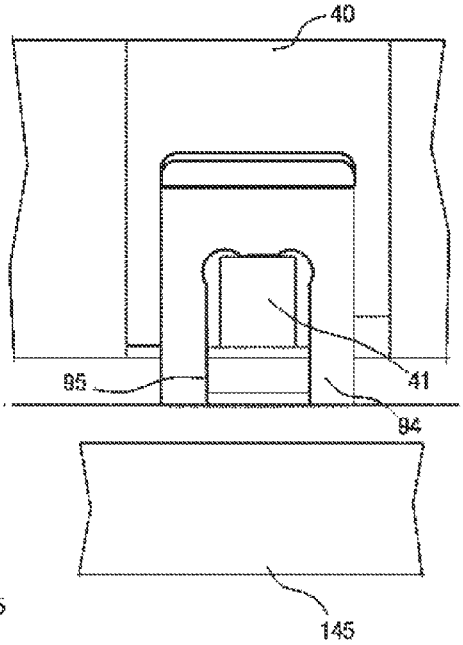

The hook 94 is then pushed up, that is, in the direction of arrow B in FIG. 13A, and the top of the through-hole 95 in the hook 94 engages the matching protrusion 41 of the antenna 40 as shown in FIG. 13B. As a result, the claw-like protrusion 41 protrudes to the outside of the through-hole 95 in the hook 94 as shown in FIG. 13A.

Because the ground plane 96 is fastened by screws 111 to the main plate 145 and is made of a flexible metal as described above, the antenna 40 engaged with the hooks 94 is urged toward the main plate 145, that is, in the direction of arrow C in FIG. 13A, and pressed against the pedestals 113, by lifting the hooks 94 up in the direction of arrow B as shown in FIG. 13A. The antenna 40 is thus reliably positioned vertically to the main plate 145.

As shown in FIG. 11, the dial ring 83 is disposed vertically above the antenna 40. More specifically, dial ring cavities 83*a* are formed in the bottom of the dial ring 83 as top member cavities that engage the dial ring studs 115 as shown in FIG. 11. When installing the dial ring 83, the dial ring studs 115 disposed to the main plate 145 are engaged in the dial ring cavities 83*a*.

The dial ring studs 115 are top member protrusions formed protruding vertically from the main plate 145, are round columns as shown in FIG. 10, and the matching dial ring cavities 83*a* are cylindrically shaped. Therefore, by fitting the dial ring studs 115 to the dial ring cavities 83*a*, the dial ring 83 is positioned to the main plate 145 in the plane direction, and the center of the main plate 145 is aligned with the virtual center of the dial ring 83. The dial ring 83 is also positioned circumferentially to the main plate 145 by fitting the dial ring cavities 83*a* onto the dial ring studs 115. The dial ring 83 is thus positioned in the plane direction and circumferentially to the main plate 145.

As shown in FIG. 11, the dial ring studs 115 and antenna studs 112 are disposed so that the length in the radial direction from the center of the dial ring stud 115 to the center of the antenna stud 112 is a specific distance G2. This distance G2 is set so that the gap 43 between the antenna 40 and the dial ring 83 is a specific distance G1 when the antenna 40 and dial ring 83 are engaged with the main plate 145.

The configuration for positioning the antenna 40 in this embodiment of the invention thus disposes the antenna 40 in a compartment enclosed by the dial ring 83 and the bezel 82 with a specific distance G1 to the dial ring 83.

D. Benefits of the Embodiment

The antenna 40 and dial ring 83 in this embodiment of the invention are positioned relative to the movement 140 by engagement of the antenna studs 112 and dial ring studs 115. The antenna studs 112 and dial ring studs 115 are formed in unison from the main plate 145 of the movement 140 with a specific distance G2 therebetween in the radial direction maintaining a distance G1 between the antenna 40 and dial ring 83. Variation in the relative positions of the antenna 40 and dial ring 83 can therefore be suppressed. As a result, the effect of the dial ring 83 on the antenna 40 can be held constant, and good antenna reception performance can be maintained.

The antenna 40 is disposed in a space enclosed by the dial ring 83 and bezel 82, and when the timepiece is subject to shock or vibration, the position of the antenna 40 in this space may change.

In this embodiment, however, the distance from the position where a hook 94 of the ground plane 96 engages a protrusion 41 of the antenna 40, to the position where the ground plane 96 is attached to the main plate 145 of the movement 140 by a screw 111, is set to a specific gap in the circumferential direction of the main plate 145 of the movement 140.

Flexibility can therefore be imparted to the ground plane 96, and the antenna 40 can be urged by the flexibility of the ground plane 96 so that the antenna 40 returns to the original position when the antenna 40 is displaced vertically by impact or vibration.

The distance G1 between the antenna 40 and dial ring 83 is set in a range where the ground plane 96 remains flexible. More specifically, when the antenna 40 is displaced from the normal position, the top of the antenna 40 contacts the bottom of the dial ring 83.

Because the distance G1 between the antenna 40 and dial ring 83 is set so that the ground plane 96 is flexible even when the top of the antenna 40 contacts the bottom of the dial ring 83, the antenna 40 can be returned to the normal state by the elasticity of the ground plane 96 without the ground plane 96 being plastically deformed. Impact on the antenna 40 can therefore be alleviated, and damage to the antenna 40 can be reliably prevented.

As described above, this embodiment of the invention can keep the effect of the dial ring 83 on the antenna 40 constant, and maintain good antenna reception performance, even when a plastic or other dial ring is disposed close to the top of the antenna 40 vertically. Furthermore, when the timepiece is subject to shock or vibration, damage to the antenna 40 in the antenna compartment can be reliably prevented.

The number of screw holes 141, antenna studs 112, pedestals 113, and dial ring studs 115 in the foregoing embodiment is merely one example, but the invention is not so limited and the numbers can be desirably increased or decreased. The ground plane 96 is also not limited to being metal, and any elastic material can be used.

A ring-shaped ground plane is described in the foregoing embodiment, but the ground plane could be divided desirably into sections that are separately attached to the movement.

The above embodiment describes using hooks with through-holes therein, but the hooks do not need to be shaped this way, and any desirable configuration enabling engaging protrusions 41 on the antenna can be used.

E. Other Embodiments

Figure 14:
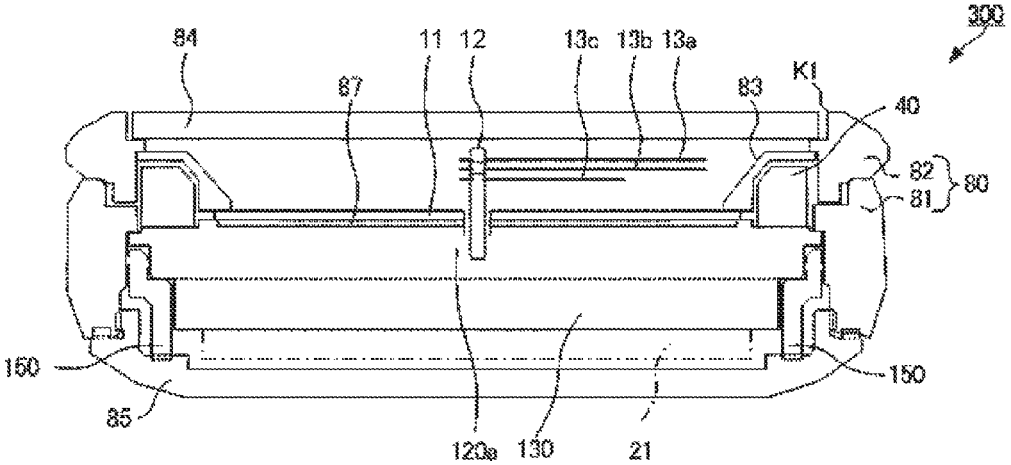
FIG. 14 is a side view of an electronic timepiece 300 according to another embodiment of the invention.
Figure 15:
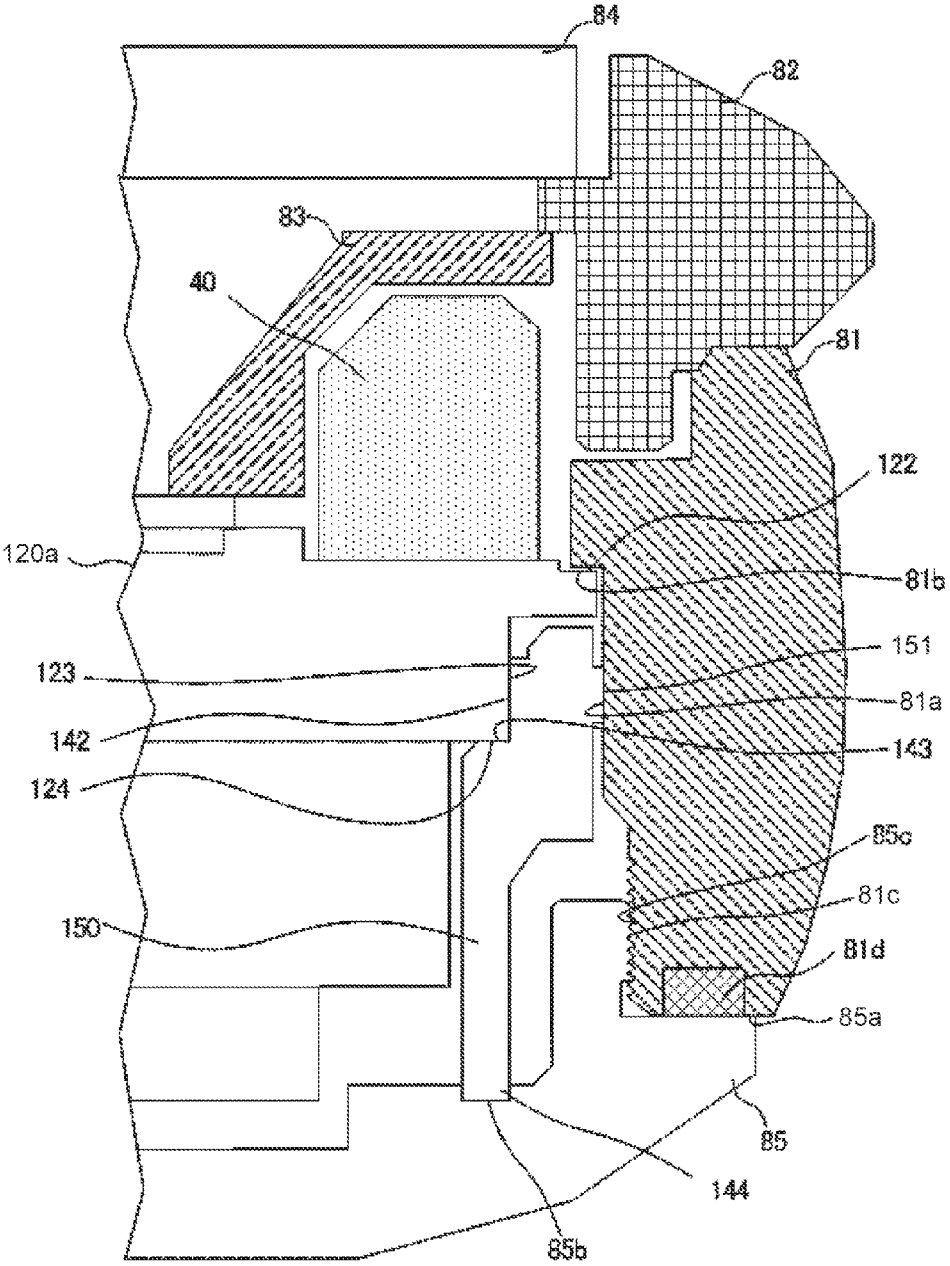
FIG. 15 is a partial section view showing the structure that fixes the movement to the outside case of the electronic timepiece 300.

The invention is not limited to the foregoing embodiments, and can be varied in many ways. FIG. 14 is a side view of an electronic timepiece 300 according to another embodiment of the invention, and FIG. 15 is a section view showing the fastening structure of this electronic timepiece 300. Like parts in this and the first embodiment are identified by like reference numerals, the function thereof is the same unless otherwise stated, and further description thereof is omitted below.

The movement 110 and circuit bridge 130 are separate members in the first embodiment described above, and the circuit bridge 130 is used for positioning vertically to the timepiece. This embodiment of the invention renders the movement 110 and circuit bridge 130 in unison, and uses a spacer 150 that is separate from the movement 110 for positioning vertically to the timepiece.

As shown in FIG. 14, the structure for fastening the movement 110 in this embodiment of the invention includes the main plate 120*a* of the movement 110, the circuit bridge 130, the spacer 150, and the body 81. The main plate 120*a* of the movement 110 and the circuit bridge 130 are formed in unison, and are made of a hard material with a specific strength.

The spacer 150 is disposed between the main plate 120*a* and circuit bridge 130 and the body 81. The spacer 150 positions the main plate 120*a* to the case 80, and is a member that is softer and more flexible than the main plate 120*a*. To position the main plate 120*a* horizontally to the body 81, the spacer 150 has a spacer outside diameter engaging part 151 that contacts the horizontal positioning surface 81*a*, and a spacer inside diameter positioning surface 142 that contacts the movement outside diameter engaging part 123 disposed to the outside surface of the main plate 120*a*, as shown in FIG. 15.

When the spacer 150 is inserted between the main plate 120*a* and body 81, the movement outside diameter engaging part 123 contacts the spacer inside diameter positioning surface 142, the spacer outside diameter engaging part 151 contacts the horizontal positioning surface 81*a*, and the spacer outside diameter engaging part 151 is pushed to the outside. As a result, the main plate 120*a* is positioned horizontally to the body 81.

To position the main plate 120*a* to the body 81 vertically, the spacer 150 has a spacer lifter 144 that engages the back cover 85 and pushes the movement to the face side, and a movement lifter 143 that contacts the bottom 124 of the main plate 120*a* at the shoulder of the main plate 120*a*. Similarly to the upward pressure part 131, the spacer lifter 144 also has protrusions that project down. The movement top positioning part 122 that contacts the vertical positioning surface 81*b* of the case 80 is disposed on the main plate 120*a* side.

When the main plate 120*a* is placed inside the body 81, and the back cover 85 is attached from the back cover 85 side opening of the body 81, the protruding part fits into the pressure channel 85*b* of the back cover 85. The spacer lifter 144 transfers reaction from the back cover 85 to the main plate 120*a* when the body 81 is fit onto the main plate 120*a* on the back cover 85, the spacer lifter 144 is pushed up (in), and the movement lifter 143 pushes up on the bottom 124 resting thereon.

When the movement lifter 143 pushes the bottom 124 up, the movement top positioning part 122 at the top is pushed against the vertical positioning surface 81*b* of the body 81, and the main plate 120*a* is positioned and fixed vertically to the body 81. As a result, a constant gap can be held between the antenna 40 and the case 80, the effect of the case 80 can be kept constant, and good antenna reception performance can be maintained.

In addition, because the spacer 150 is made from a different material than the main plate 120*a*, the pliability to reaction from the back cover 85, and the strength required to secure the movement, can be controlled, and the ease and freedom of design can be improved.

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom.

The entire disclosures of Japanese Patent Application Nos. 2012-209029, filed Sep. 24, 2012 and 2012-209031, filed Sep. 24, 2012 are expressly incorporated by reference herein.

What is claimed is:

1. An electronic timepiece with internal antenna, comprising:

a tubular outside case;

a time display unit that displays time inside the case;

a back cover that closes a case opening on the opposite side as the display side of the time display unit;

a movement including a drive mechanism that drives the time display unit and a main plate that supports the drive mechanism;

a vertical positioning surface being a portion of the case that projects in the radial direction of the case on the inside of the case; and an annular antenna that is held inside the case and is positioned relative to the movement;

the main plate having an upward pressure part that engages the back cover and lifts the movement to the time display side, and a movement top positioning part being a portion of the main plate that contacts the vertical positioning surface and positions the movement vertically to the case when the upward pressure part lifts the movement to the time display side.

2. The electronic timepiece with internal antenna described in claim 1, wherein:

a horizontal positioning surface is formed on the inside surface of the outside case; and a movement outside diameter engaging part that contacts the horizontal positioning surface and determines the horizontal position relative to the outside case is formed on the main plate.

3. The electronic timepiece with internal antenna described in claim 1, wherein:

the main plate includes a first member made of a hard material disposed on the face side of the time display unit, and a second member made of a softer material than the first member and disposed on the back cover side, the movement outside diameter engaging part and movement top positioning part being disposed to the first member, and the upward pressure part being disposed to the second member.

4. The electronic timepiece with internal antenna described in claim 1, wherein:

the upward pressure part is formed by a member separate from the main plate.

5. The electronic timepiece with internal antenna described in claim 4, wherein:

the upward pressure part is disposed between the main plate and the outside case, and includes a spacer outside diameter engaging part that contacts the horizontal positioning surface formed on the inside of the outside case, a spacer inside diameter positioning surface that contacts a movement outside diameter engaging part disposed to the outside surface of the main plate, a spacer lifter that engages the back cover and lifts the movement to the time display side, and a movement lifter that contacts a shoulder formed on the outside surface of the main plate.

6. The electronic timepiece with internal antenna described in claim 1, wherein:

the antenna receives signals from a positioning information satellite; and the movement is driven to display time based on the received signals.

7. An electronic timepiece with internal antenna, comprising:

a tubular outside case;

a movement housed inside the outside case and including a drive mechanism that drives a time display unit and a main plate that supports the drive mechanism;

an annular antenna that is held inside the outside case;

a top member that is disposed above the antenna and covers the antenna, and is separate from the main plate;

an antenna engaging part that positions the antenna relative to the movement; and a top member engaging part that positions the top member relative to the movement;

the antenna engaging part and the top member engaging part being formed with the main plate.

8. The electronic timepiece with internal antenna described in claim 7, wherein:

the antenna engaging part positions and prevents the antenna from moving horizontally and circumferentially to the main plate; and the top member engaging part positions and prevents the top member from moving horizontally and circumferentially to the main plate.

9. The electronic timepiece with internal antenna described in claim 7, wherein:

the antenna engaging part has an antenna protrusion formed protruding vertically from the main plate; and the antenna has an antenna cavity that engages the antenna protrusion.

10. The electronic timepiece with internal antenna described in claim 7, wherein:

the top member engaging part has a top member protrusion formed protruding vertically from the main plate; and the top member has a top member cavity that engages the top member protrusion.

11. The electronic timepiece with internal antenna described in claim 7, wherein:

the top member is a dial ring that has an annular shape corresponding to the shape of the antenna.

* * * * *